US005183729A

United States Patent [19]

Naito et al.

[11] Patent Number: 5,183,729

[45] Date of Patent: Feb. 2, 1993

[54] METHOD FOR FORMING COLOR IMAGE

[75] Inventors: Hideki Naito; Shigeki Yokoyama; Jiro Tsukahara, all of Minami-ashigara, Japan

[73] Assignee: Fuji Photo Film Co., Ltd., Kanagawa, Japan

[21] Appl. No.: 677,252

[22] Filed: Mar. 29, 1991

[30] Foreign Application Priority Data

Mar. 12, 1990 [JP] Japan ..... 2-153629
Mar. 30, 1990 [JP] Japan ..... 2-85620
Jan. 31, 1991 [JP] Japan ..... 3-31637

[51] Int. Cl.[5] ..... G03C 7/30; G03C 7/34

[52] U.S. Cl. ..... 430/385; 430/384; 430/552; 430/553

[58] Field of Search ..... 430/384, 385, 552, 553

[56] References Cited

U.S. PATENT DOCUMENTS

| | | | |
|---|---|---|---|
| 2,367,531 | 1/1945 | Salminen et al. | 430/552 |
| 3,002,836 | 10/1961 | Vittum et al. | 430/552 |
| 3,772,002 | 11/1973 | Ramello | 430/553 |
| 4,288,532 | 9/1981 | Seoka et al. | 430/553 |
| 4,333,999 | 6/1982 | Lau | 430/553 |
| 4,560,630 | 12/1985 | Salomon et al. | 429/194 |
| 4,609,619 | 9/1986 | Katoh et al. | 430/553 |
| 4,775,616 | 10/1988 | Kilminster et al. | 430/553 |
| 4,885,234 | 12/1989 | Zengerle | 430/552 |
| 5,021,555 | 6/1991 | Szajewski et al. | 430/553 |

*Primary Examiner*—Richard L. Schilling
*Attorney, Agent, or Firm*—Birch, Stewart, Kolasch & Birch

[57] ABSTRACT

There is disclosed a method for forming a color image which comprises developing a silver halide color photographic material having a layer containing a cyan coupler represented by formula (I) with a color developer containing a color-developing agent represented by formula (D)

Formula (I)

wherein $R^1$ represents an alkyl group, an alkenyl group, or a cycloalkyl group, $R^2$ represents an alkyl group, alkenyl group, or cycloalkyl group having 4 to 30 carbon atoms in total, $R^3$ represents an aryl group, and Z represents a hydrogen atom or a group capable of being released upon a coupling reaction, with a color developer containing a color-developing agent represented by the following formula (D):

Formula (D)

wherein $R^4$ represents a hydrogen atom, a halogen atom, or a methyl group, $R^5$ and $R^6$ each represent a methyl group or an ethyl group, L represents a methylene group or an ethylene group, and n is 1 or 2.

21 Claims, No Drawings

METHOD FOR FORMING COLOR IMAGE

FIELD OF THE INVENTION

The present invention relates to a method for forming a color image, particularly to a method for forming a color image by chromogenically developing a silver halide color photographic material, and more particularly to a method for forming a color image by developing a silver halide photographic material containing a specific cyan coupler with a color developer containing a specific color-developing agent.

BACK GROUND OF THE INVENTION

Generally, silver halide color photographic materials are designed in such a manner that coupling reactions with the oxidized product of an aromatic primary amine color developer are caused to take place in the presence of three primary color couplers, namely, a yellow coupler capable of forming yellow, a magenta coupler capable of forming magenta (reddish purple), and a cyan coupler capable of forming cyan (greenish blue), thereby producing a yellow dye, a magenta dye, and a cyan dye from the couplers, to obtain a color image.

In recent years, color photographic materials have improved greatly in performance in concert with the progress of technology. In particular, there is remarkable progress in improvement in color reproduction quality as well as fastness of color images during storage. On the other hand, the demand for simple and rapid processing of color photographic materials is increasing and photographic materials are required to have adaptability to simple or rapid processing. That is, the development of a photographic material that has adaptability to short-term development processing and whose finish is less fluctuated by the processing conditions is demanded.

In order to meet the demand, for example, development of pyrazoloazole couplers capable of forming magenta dyes whose yellow subsidiary absorption is less, development of techniques for preventing various image dyes from fading, and development of techniques for rapid processing have made steady progress.

However, concerning color reproduction, it cannot be said that color reproduction in the range from yellow to green is yet satisfactory.

As cyan couplers of silver halide color photographic materials, conventionally 2-amidophenol cyan couplers disclosed, for example, in U.S. Pat. Nos. 2,367,531, 3,772,002, and 4,560,630, 2-ureidophenol cyan couplers disclosed, for example, in U.S. Pat. No. 4,333,999, and naphthol cyan couplers disclosed, for example, in U.S. Pat. No. 3,002,836 have been and presently are widely used. Among these cyan couplers, the above 2-amidophenol cyan couplers are used particularly in photographic materials for prints, since particularly the maximum absorption wavelength of the cyan dyes produced therefrom is a relatively short wavelength, and the above 2-ureidophenol cyan couplers and naphthol cyan couplers are used in photographic materials for negatives in particular, since the maximum absorption wavelength of the cyan dyes produced therefrom is a relatively long wavelength.

Further, cyan couplers used in silver halide color photographic materials are required to have various performances. The performances include, for example, that the hue produced by the coupling reaction of the cyan coupler with the oxidized product of an aromatic primary amine color developer is good, that the said coupling reaction proceeds at a favorable speed, that the cyan image formed by the said coupling reaction is fast to light, heat, and humidity, and that after the production of the silver halide color photographic material the cyan coupler does not decompose to form yellow, red, magenta, or cyan stain or other stain, and research to improve these performances is being continued incessantly in the photographic industry.

In particular, cyan couplers in photographic materials for prints for forming final positive images are severely required to have the above performances. On one hand, because photographic materials for negatives are not used for direct appreciation, defect-correcting means, such as color correction at the time of printing or masking using a colored coupler, can be adopted even if the hue of a cyan dye is not good. On the other hand, because photographic materials for prints are used for direct appreciation, such defect-correcting means cannot be adopted. If the hue of a cyan dye is not good, only a color print image whose color is different from that of the subject, i.e., a color print image poor in color reproduction quality, is obtained.

Thus, when a cyan coupler is used in a color photographic material for prints, more stringent performance is required than that of a color photographic material for negatives, especially that the hue of a cyan, i.e., the maximum absorption wavelength of a cyan is suitable and the absorption shape is sharp is essential for improving the color reproduction quality of color prints.

However, a dye produced from a 2-amidophenol coupler used conventionally in photographic materials for prints and a p-phenylenediamine color-developing agent have defects that the subsidiary absorption at the yellow part is high and the absorption at the magenta part is also high. Therefore, as long as conventional phenol couplers are used, there is a limit to the improvement of color reproduction quality. As a technique for improving absorption properties of dyes by phenol couplers, a technique is known wherein a naphthol coupler having a special structure is agglomerated to be used as described in U.S. Pat. No. 4,288,532, but the technique does not assure adequate performance.

Further, there is a problem that when short-term processing is effected, the stability of the finish is not adequate.

SUMMARY OF THE INVENTION

Therefore, the first object of the present invention is to provide a method for forming a cyan coupler image whose maximum absorption wavelength is at 630 to 650 nm and whose absorption shape is sharp; that is, a cyan color image improved in hue.

The second object of the present invention is to provide a color-image forming method for color prints to attain the above object.

The third object of the present invention is to provide a hue-improving means of shifting the maximum absorption wavelength of a cyan dye greatly to a short wavelength and making the absorption shape sharp.

The fourth object of the present invention is to provide a color image-forming method suitable for short-term processing.

Other and further objects, features, and advantages of the invention will appear more fully from the following description.

DETAILED DESCRIPTION OF THE INVENTION

The above objects have been attained by providing a method for forming a color image, characterized in that a silver halide color photographic material having at least one layer containing a cyan coupler represented by the following formula (I):

Formula (I)

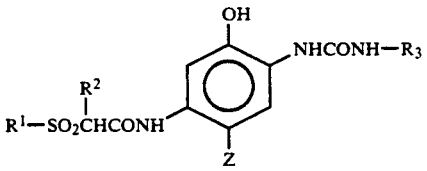

wherein $R^1$ represents an alkyl group, an alkenyl group, or a cycloalkyl group, $R^2$ represents an alkyl group, alkenyl group, or cycloalkyl group having 4 to 30 carbon atoms in total, $R^3$ represents an aryl group, and Z represents a hydrogen atom or a group capable of releasing upon coupling reaction (hereinafter referred to as a coupling split-off group), is developed with a color developer containing a color-developing agent represented by the following formula (D):

Formula (D)

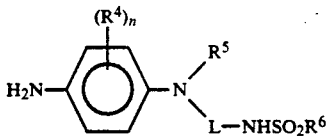

wherein $R^4$ represents a hydrogen atom, a halogen atom, or a methyl group, $R^5$ and $R^6$ each represent a methyl group or an ethyl group, L represents a methylene group or an ethylene group, and n is 1 or 2.

A preferable maximum absorption wavelength of cyan dyes of photographic materials for prints is 630 to 650 nm, whereas a preferable maximum absorption wavelength of cyan dyes of photographic materials for negatives is 670 to 700 nm, thus there is a great difference between them, and therefore it has been considered substantially impossible for cyan couplers that give a preferable maximum wavelength to photographic materials for prints to be used for photographic materials for negatives, or conversely for cyan couplers that give a preferable maximum absorption wavelength to photographic materials for negatives to be used for photographic materials for prints.

On one hand, 4-amino-3-methyl-N-ethyl-N-(β-methanesulfonamidoethyl)aniline, having a sulfonamido group in the dialkylamino moiety, is generally used as a color-developing agent for the color development of photographic materials for prints. And on the other hand, 4-amino-3-methyl-N-ethyl-N-(β-hydroxyethyl-)aniline, having a hydroxy group in the dialkylamino moiety, is generally used as a color developing-agent for the color development of photographic materials for negatives. Although it is recognized that when a color photographic material containing a cyan coupler is developed with the above color developer for prints, the maximum absorption wavelength of the formed cyan dye is made shorter in comparison with the case when the color photographic material containing that cyan coupler is developed with the above color developer for negatives, the extent has generally been 5 to 15 nm. Therefore, it has been considered substantially impossible to use said 2-amidophenol cyan couplers for photographic materials for negatives, or conversely to use said 2-ureidophenol cyan couplers or naphthol cyan couplers for photographic materials for prints.

To make sharp the absorption shape of the cyan dye formed from a cyan coupler for prints could not be attained even when the said photographic material for negatives was chromogenically developed with a color developer for chromogenically developing photographic materials for prints containing 4-amino-3-methyl-N-ethyl-(β-methanesulfonamidoethyl)aniline. That is, when a color photographic material containing a cyan coupler was developed with the said color developer for prints, the absorption shape of the produced cyan dye was not substantially changed in comparison with the case when the color photographic material containing that cyan coupler was chromogenically developed with the above color developer for negatives.

Accordingly, in this respect, it has been considered substantially impossible that even a cyan coupler preferable for photographic materials for negatives could be preferably used for photographic materials for prints.

We have found that when a silver halide color photographic material containing a specific 2-ureido cyan coupler is chromogenically developed with a color developer containing a specific color-developing agent represented by formula (D), the maximum absorption wavelength is shortened by 40 to 50 nm, to give a value of 630 to 650, the absorption shape is greatly sharpened, and particularly the half-bandwidth on the half value side on the short wavelength side can be brought to 54 nm or less, thereby forming a cyan dye for print photographic materials, which has hitherto not been known at all, leading to the completion of the present invention. That cyan dye is one whose absorption shape has been made much sharper than the absorption shape of the cyan dye produced from the known cyan couplers for print photographic materials.

The inventors have noted, incidentally, that 2-ureido cyan couplers having a sulfonyl group at the 5-position ballasting section are disclosed, for example, in U.S. Pat. No. 4,775,616 and JP-A ("JP-A" means unexamined published Japanese patent application) Nos. 13942/1990 and 125252/1990 and that some of the present cyan couplers represented by formula (I) are disclosed specifically in these patent specifications. However, these specifications describe specific modes only wherein development is made using color developers for negatives containing 4-amino-3-methyl-N-ethyl-(β-hydroxyethyl)aniline, and they do not suggest at all that when development is made using a color developer containing a color-developing agent represented by formula (D) as described above, the maximum absorption wavelength is made considerably shorter, uniquely as described above, and that the absorption shape is made sharp greatly, which are effects that are not expected from the prior knowledge.

On the other hand, JP-B ("JP-B" means examined Japanese patent publication) No. 11656/1988 also discloses 2-ureido cyan couplers having a sulfonyl group at the 5-position ballasting section and describes examples in which a photographic material containing a said cyan coupler is developed with a color developer for prints containing 4-amino-3-methyl-N-ethyl-N-(β-methanesulfonamidoethyl)aniline, but it does not specifically mention the present specific 2-ureido cyan coupler nor does it suggest at all that the maximum absorption wavelength is considerably made short uniquely and the absorption shape is greatly sharpened, which are effects that are not expected from the prior knowledge.

The effects, which are not known from the prior art, that when development is carried out with a color developer containing a color-developing agent represented by formula (D), the maximum absorption wavelength is considerably made short and the absorption shape is sharpened are not common to 2-ureido cyan couplers having a sulfonyl group at the 5-position ballasting section, but these effects are uniquely exhibited when the 5-position ballasting group has a specific structure as represented by formula (I).

The present cyan coupler represented by formula (I) will now be described in more detail.

In formula (I), $R^1$ represents a linear or branched alkyl group having preferably a total number of carbon atoms (hereinafter, abbreviated as C-number) of 1 to 30, more preferably 6 to 24, a linear or branched alkenyl group having a total C-number of 2 to 30, more preferably 6 to 24, or a 3- to 12-membered cycloalkyl group having a total C-number of 3 to 30, more preferably 6 to 24, which may be substituted (e.g., by a halogen atom, a hydroxyl group, a carboxyl group, a sulfo group, a cyano group, a nitro group, an amino group, an alkyl group, an alkenyl group, an alkynyl group, a cycloalkyl group, an aryl group, an alkoxy group, an aryloxy group, an alkylthio group, an arylthio group, an alkylsulfonyl group, an arylsulfonyl group, an acyl group, an acyloxy group, an alkoxycarbonyl group, an aryloxycarbonyl group, a carbonamido group, a sulfonamido group, a carbamoyl group, a sulfamoyl group, a ureido group, an alkoxycarbonylamino group, a sulfamoylamino group, an alkoxysulfonyl group, an imido group, or a heterocyclic group, which are hereinafter referred to as a substituent group A). More preferably $R^1$ represents a linear or branched alkyl group [e.g., n-octyl, n-decyl, n-dodecyl, n-hexadecyl, 2-ethylhexyl, 3,5,5-trimethylhexyl, 3,5,5-trimethylhexyl, 2-ethyl-4-methylpentyl, 2-hexyldecyl, 2-heptylundecyl, 2-octyldodecyl, 2,4,6-trimethylheptyl, 2,4,6,8-tetramethylnonyl, benzyl, 2-phenetyl, 3-(t-octylphenoxy)propyl, 3-(2,4-di-t-pentylphenoxy)propyl, 2-(4-biphenyloxy)ethyl, 3-dodecyloxypropyl, 2-dodecylthioethyl, 9,10-epoxyoctadecyl, dodecyloxycarbonylmethyl, and 2-(2-naphthyloxy)ethyl], which may be unsubstituted or substituted by a substituent (e.g., an alkoxy group, an alkylthio group, an aryloxy group, an arylthio group, an alkylsulfonyl group, an arylsulfonyl group, an aryl group, an alkoxycarbonyl group, an epoxy group, a cyano group, or a halogen atom); an alkenyl group [e.g., allyl, 10-undecenyl, oleyl; citronellyl, and cinnamyl], which may be unsubstituted or substituted by a substituent (e.g., a halogen atom, an aryl group, an alkoxy group, an alkylthio group, an aryloxy group, an arylthio group, or an alkoxycarbonyl group); a cycloalkyl group [e.g., cyclopentyl, cyclohexyl, 3,5-dimethylcyclohexyl, and 4-t-butylcyclohexyl], which may be substituted or unsubstituted by a substituent (e.g., a halogen atom, an alkyl group, a cycloalkyl group, an aryl group, an alkoxy group, or an aryloxy group); with the above linear or branched unsubstituted or substituted alkyl group particularly preferable.

$R^2$ represents a linear or branched alkyl group having a total C-number of 4 to 30, preferably 4 to 20, and particularly preferably 4 to 10, a linear or branched alkenyl group having a total C-number of 4 to 30, more preferably 4 to 24, or a cycloalkyl group having a total C-number of 4 to 30, more preferably 4 to 24, which may be substituted by a substituent selected from the substituent group A. More preferably $R^2$ represents a linear or branched alkyl group (e.g., n-butyl, i-butyl, n-amyl, i-amyl, t-amyl, n-hexyl, n-heptyl, n-octyl, n-decyl, n-dodecyl, n-hexadecyl, 2-ethylhexyl, 3,5,5-trimethylhexyl, 3,5,5-trimethylhexyl, 2-ethyl-4-methylpentyl, 2-hexyldecyl, 2-heptylundecyl, 2-octyldodecyl, 2,4,6-trimethylheptyl, 2,4,6,8-tetramethylnonyl, benzyl, 2-phenetyl, 3-(t-octylphenoxy)propyl, 3-(2,4-di-t-pentylphenoxy)propyl, 2-(4-biphenyloxy)ethyl, 3-dodecyloxypropyl, 2-dodecylthioethyl, 9,10-epoxyoctadecyl, dodecyloxycarbonylmethyl, and 2-(2-naphthyloxy)ethyl], which may be unsubstituted or substituted (e.g., by an alkoxy group, an alkylthio group, an aryloxy group, an arylthio group, an alkylsulfonyl group, an allylsulfonyl group, an aryl group, an alkoxycarbonyl group, an epoxy group, a cyano group, or a halogen atom); an alkenyl group [e.g., allyl, 10-undecenyl, oleyl, citronellyl, and cinnamyl], which may be unsubstituted or substituted (e.g., by a halogen atom, an aryl group, an alkoxy group, an alkylthio group, an aryloxy group, an arylthio group, or an alkoxycarbonyl group); a 4- to 12-membered cycloalkyl group (e.g., cyclopentyl, cyclohexyl, 3,5-dimethylcyclohexyl, and 4-t-butylcyclohexyl), which may be unsubstituted or substituted (e.g., by a halogen atom, an alkyl group, a cycloalkyl group, an aryl group, an alkoxy group, or an aryloxy group); with the above linear or branched unsubstituted or substituted alkyl group particularly preferable.

In formula (I), $R^3$ represents an aryl group preferably having a total C-number of 6 to 36, more preferably 6 to 15, which may be substituted by a substituent selected from the substituent group A or may be a condensed ring. Herein, preferable substituents include a halogen atom (e.g., F, Cl, Br, and I), a cyano group, a nitro group, an acyl group (e.g., acetyl and benzoyl), an alkyl group (e.g., methyl, t-butyl, trifluoromethyl, and trichloromethyl), an alkoxy group (e.g., methoxy, ethoxy, butoxy, and trifluoromethoxy), an alkylsulfonyl group (e.g., methylsulfonyl, propylsulfonyl, butylsulfonyl, and benzylsulfonyl), an arylsulfonyl group (e.g., phenylsulfonyl, p-tolylsulfonyl, and p-chlorophenylsulfonyl), an alkoxycarbonyl (e.g., eethoxycarbonyl and butoxycarbonyl), a sulfonamido group (e.g., methanesulfonamido, trifluoromethanesulfonamido, and toluenesulfonamido), a carbamoyl group (e.g., N,N-dimethylcarbamoyl and N-phenylcarbamoyl), or a sulfamoyl group (e.g., N,N-diethylsulfamoyl and N-phenylsulfamoyl). $R^3$ preferably represents a phenyl group having at least one substituent selected from a halogen atom, a cyano group, a sulfonamido group, an alkylsulfonyl group, an arylsulfonyl group, and a trifluoromethyl group, more preferably 4-cyanophenyl, 4-cyano-3-halogenophenyl, 3-cyano-4-halogenophenyl, 4-alkylsulfonylphenyl, 4-alkylsulfonyl-3-halogenophenyl, 4-alkylsulfonyl-3-alkoxyphenyl, 3-alkoxy-4-alkylsulfonylphenyl, 3,4-dihalogenophenyl, 4-halogenophenyl, 3,4,5-trihalogenophenyl, 3,4-dicyanophenyl, 3-cyano-4,5-dihalogenophenyl, 4-trifluoromethylphenyl, or 3-sulfonamidophenyl, particularly preferably 4-cyanophenyl, 3-cyano-4-halogenophenyl, 4-cyano-3-halogenophenyl, 3,4-dicyanophenyl, or 4-alkylsulfonylphenyl, and most preferably 4-cyanophenyl.

In formula (I), Z represents a hydrogen atom or a coupling split-off group (including a coupling split-off atom, the same being applied hereinafter). The coupling split-off group is preferably a halogen atom, an alkoxy group, an aryloxy group, or an alkylthio group, particularly preferably a chlorine atom or a group represented by the following formula (II) or (III):

Formula (II)

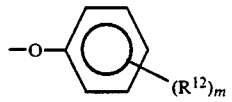

wherein $R^{12}$ represents a halogen atom, a cyano group, a nitro group, an alkyl group, an alkoxy group, an alkylthio group, an alkylsulfonyl group, an arylsulfonyl group, a carbonamido group, a sulfonamido group, an alkoxycarbonyl group, a carbamoyl group, a sulfamoyl group, or a carboxyl group, m is an integer of 0 to 5, if m is an integer of 2 to 5, groups $R^{12}$ may be the same or different.

Formula (III)

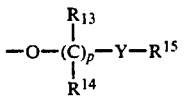

wherein $R^{13}$ and $R^{14}$ each represent a hydrogen atom or a monovalent group, Y represents -CO-, -SO-, $-SO_2-$, $-(O)P(R^{16})-$, $R^{15}$ and $R^{16}$ each represent a hydroxyl group, an alkyl group, an aryl group, an alkoxy group, an alkenyloxy group, an aryloxy group, or a substituted or unsubstituted amino group, p is an integer of 1 to 6, if p is an integer of 2 to 6, groups $-C(R^{13})(R^{14})-$ may be the same or different.

In formula (II), $R^{12}$ preferably represents a halogen atom, an alkyl group (e.g., methyl, t-butyl, t-octyl, and pentadecyl), an alkoxy group (e.g., methoxy, n-butoxy, n-octyloxy, benzyloxy, and methoxyethoxy), a carbonamido group (e.g., acetamido and 3-carboxypropaneamido), or a sulfonamido group (e.g., methanesulfonamido, toluenesulfonamido, and p-dodecyloxybenzenesulfonamido) and particularly preferably an alkyl group or an alkoxy group. m is preferably an integer of 0 to 2 and more preferably an integer of 0 or 1.

In formula (III), when $R^{13}$ and/or $R^{14}$ represents a monovalent group, preferably it is an alkyl group (e.g., methyl, ethyl, n-butyl, ethoxy, carbonylmethyl, benzyl, n-decyl, and n-dodecyl), an aryl group (e.g., phenyl, 4-chlorophenyl, and 4-methoxyphenyl), an acyl group (e.g., acetyl, decanoyl, benzoyl, and pivaloyl), or a carbamoyl group (e.g., N-ethylcarbamoyl and N-phenylcarbamoyl), and more preferably $R^{13}$ and $R^{14}$ each represent a hydrogen atom, an alkyl group, or an aryl group. In formula (III), Y preferably represents -CO- or $-SO_2-$, and more preferably -CO-. In formula (III), $R^{15}$ preferably represents an alkyl group, an alkoxy group, an alkenyloxy group, an aryloxy group, or a substituted or unsubstituted amino group and more preferably an alkoxy group or a substituted or unsubstituted amino group.

In formulae (II) and (III), the total C-number of $R^{12}$, $R^{13}$, $R^{14}$, $R^{15}$ and $R^{16}$ each are preferably 1 to 22, more preferably 1 to 12.

In formula (III), p preferably is an integer of 1 to 3 and more preferably is 1.

Specific examples of $R^1-SO_2-C(R^2)HCONH-$ in formula (I) are shown below:

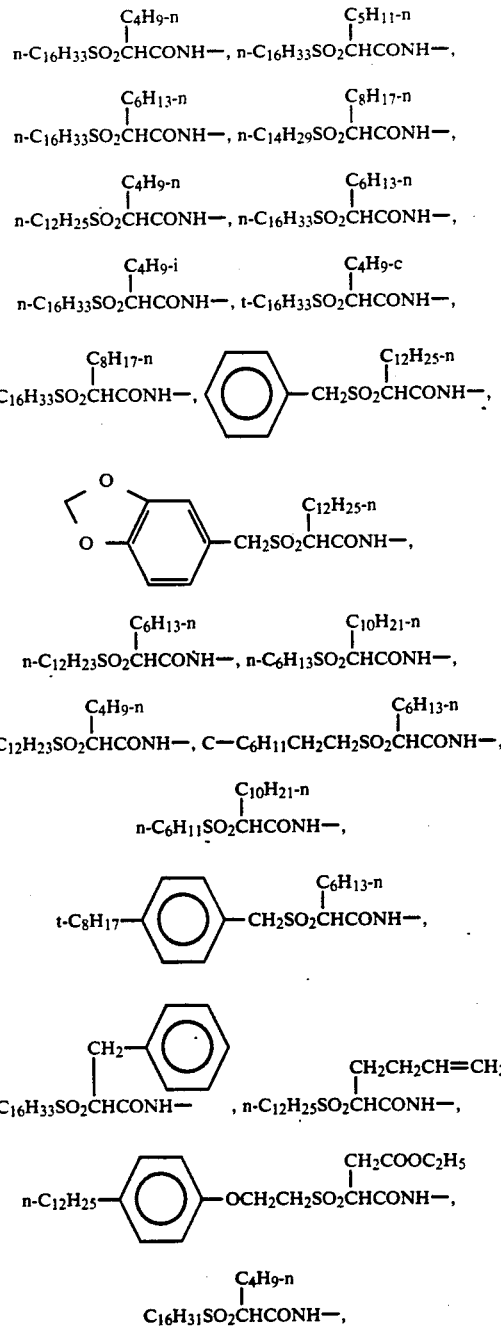

Specific examples of $R^3$ in formula (I) are shown below.

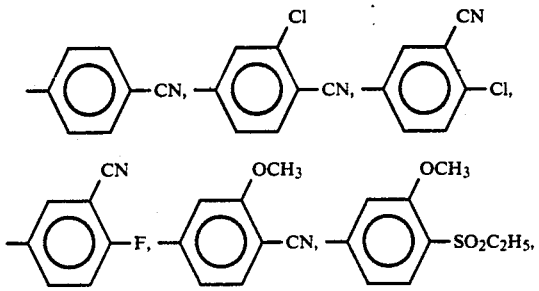

-continued
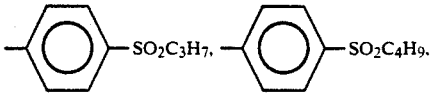
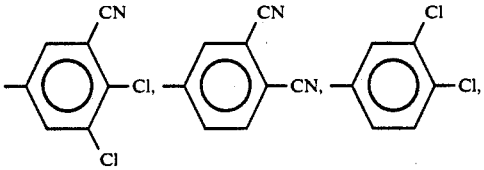
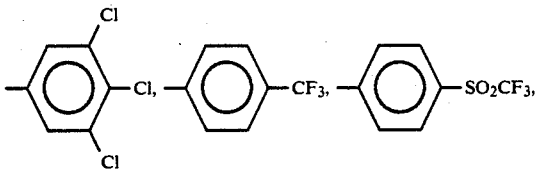
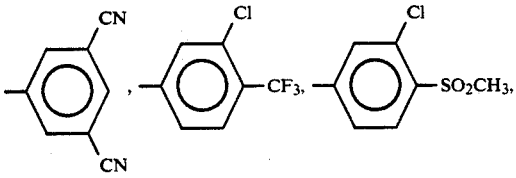
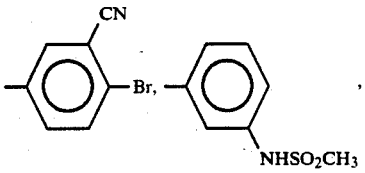
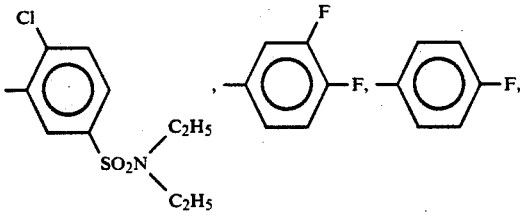
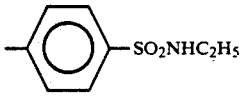
Specific examples of Z in formula (I) are shown below.
H,F,Cl, $-OC(=O)CH_3$, $-OSO_2CH_3$, $-OC(=O)OC_2H_5$, $-OC(=O)NHC_2H_5$,
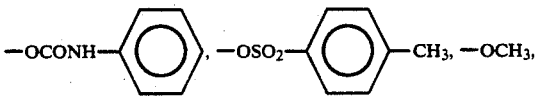
$-OC_2H_5$, $-OCH_2CH_2OCH_3$, $-OCH_2COOCH_3$,
$-OCH_2CH_2COOCH_3$, $-OCH(CH_3)COOCH_3$, $-OCH_2COOH$,
$-OCH_2CH_2SO_2CH_3$, $-OCH_2CONHCH_2CH_2OH$,
$-OCH_2CONHCH_2CH_2OCH_3$, $-OCH_2CH{=}CH_2$,
-continued
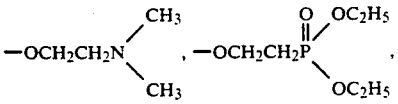
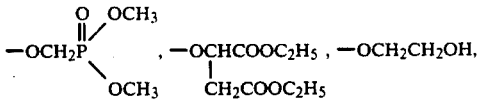
$-OCH_2CH_2SCH_2COOH$, $-OCH_2CH_2NHSO_2CH_3$,
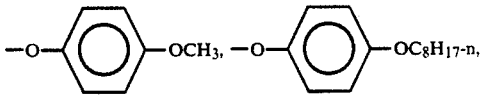
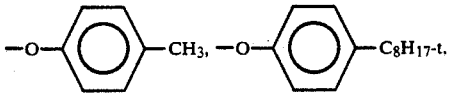
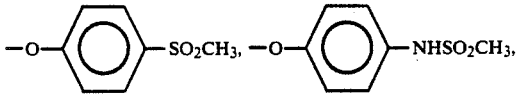
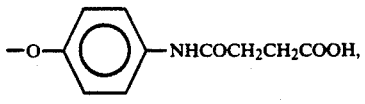
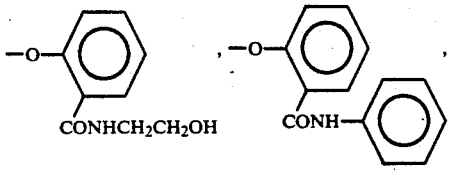
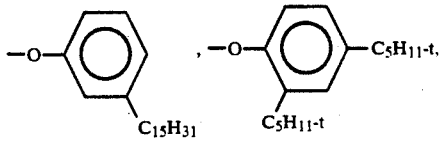
$-SCH_2COOC_2H_5$, $-SCH_2COOH$,
$-SCH_2CH_2COOH$, $-SCH(CH_3)COOH$, $-SCH_2CH_2OH$,
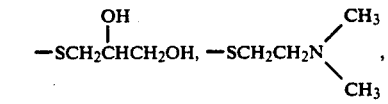
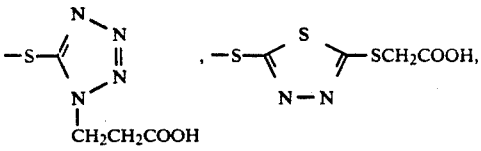
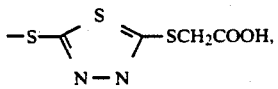

-continued

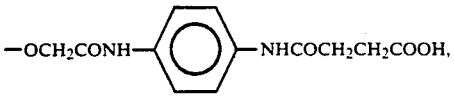

$-OCH_2COOC_4H_9$-sec, $-OCH_2COOC_4H_9$-t,

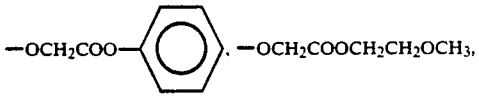

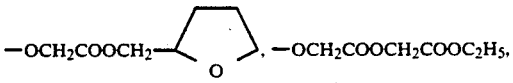

-continued

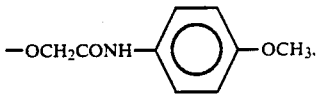

$-OCH_2COOCH_2CH_2SO_2CH_3$

When Z is a coupling split-off group, preferably it does not contain a photographically useful group (e.g., a development retarder residue and a dye residue).

Now, typical specific examples of the coupler of the present invention are shown below, but the present invention is not limited to them.

C-1

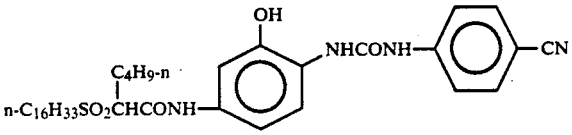

C-2

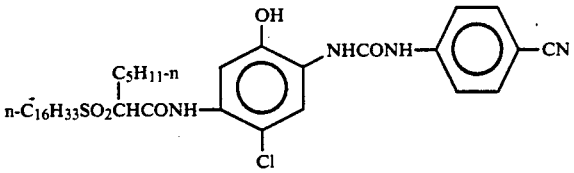

C-3

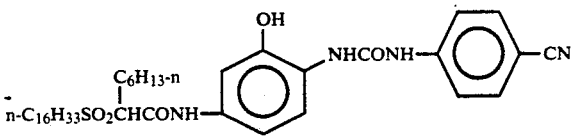

C-4

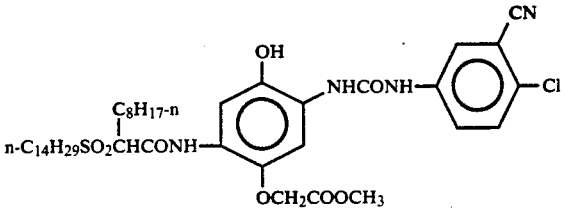

C-5

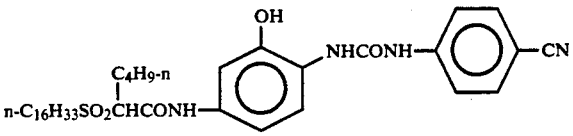

C-6

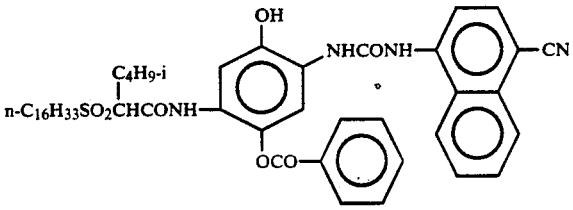

C-7

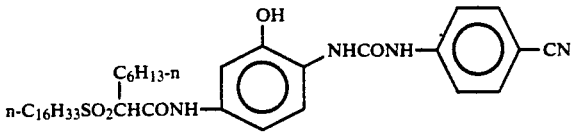

-continued
C-8
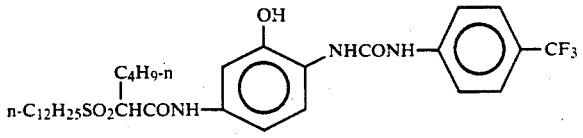
C-9
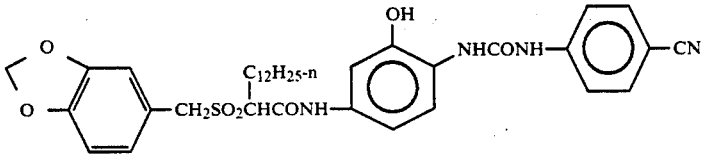
C-10
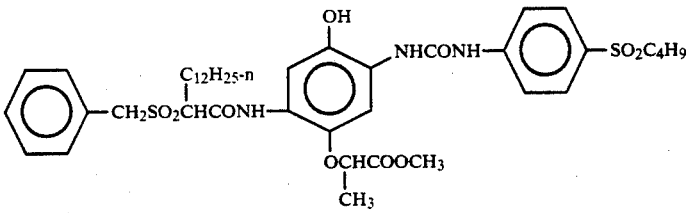
C-11
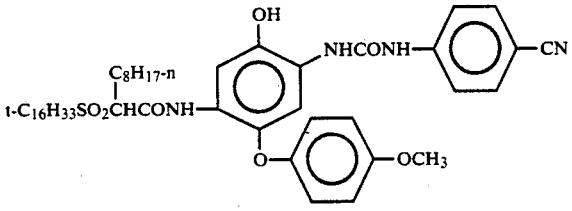
C-12
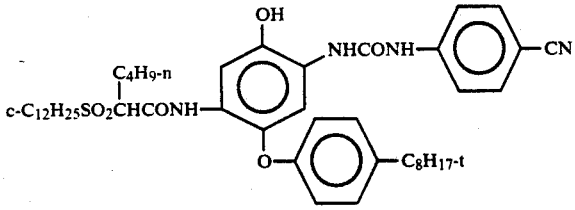
C-13
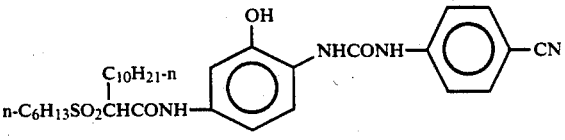
C-14
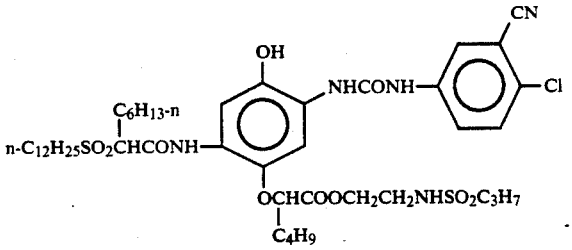
C-15
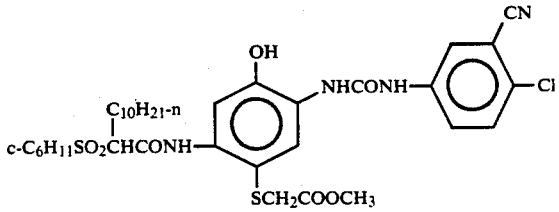

-continued
C-16
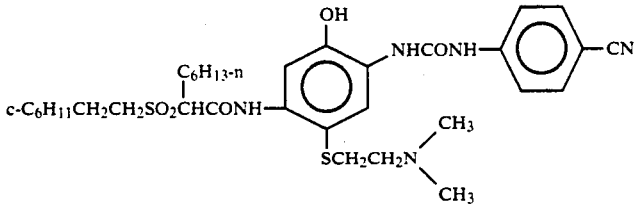
C-17
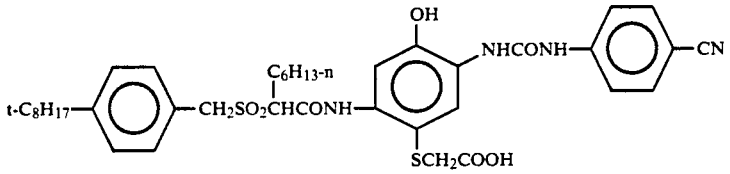
C-18
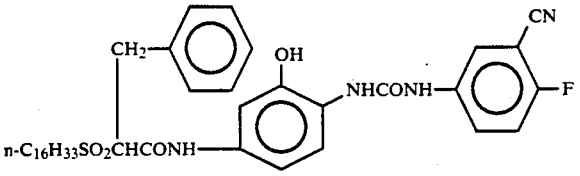
C-19
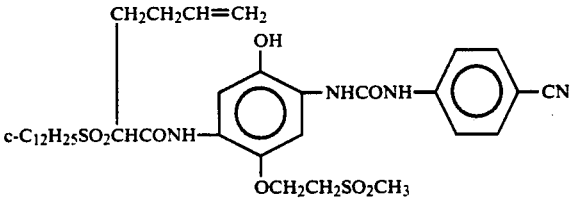
C-20
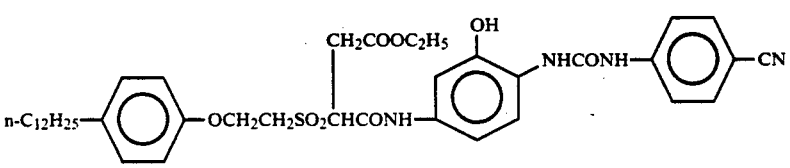
C-21
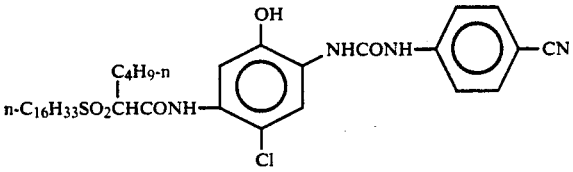
C-22
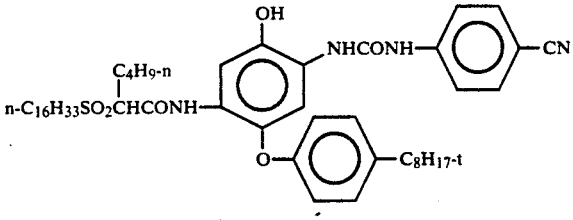
C-23
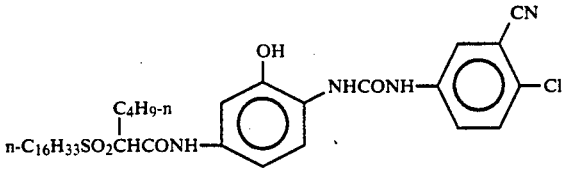

-continued
C-24
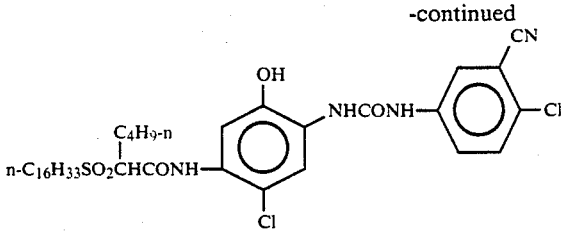
C-25
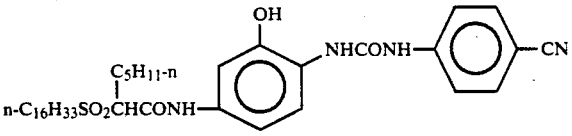
C-26
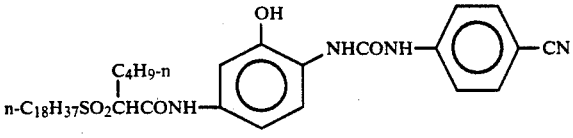
C-27
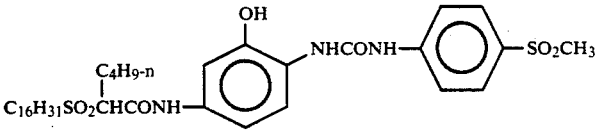
C-28
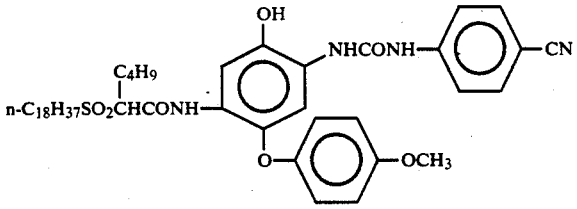
C-29
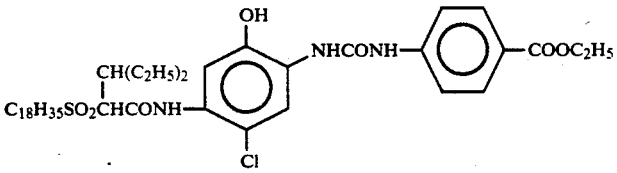
C-30
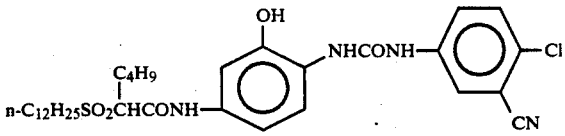
C-31
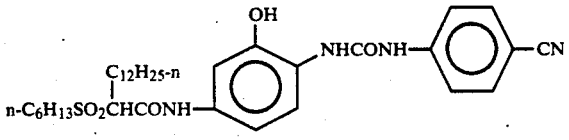
The 2-ureidophenol cyan coupler represented by formula (I) can be produced in accordance with the methods described in JP-B No. 11656/1988 and U.S. Pat. No. 4,775,616.
Processes for synthesizing couplers of the present invention will now be shown below specifically.
SYNTHESIS EXAMPLE 1
Synthesis of Present Coupler Example C-21
Synthesis Route
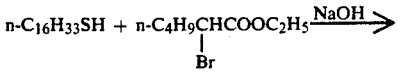

-continued

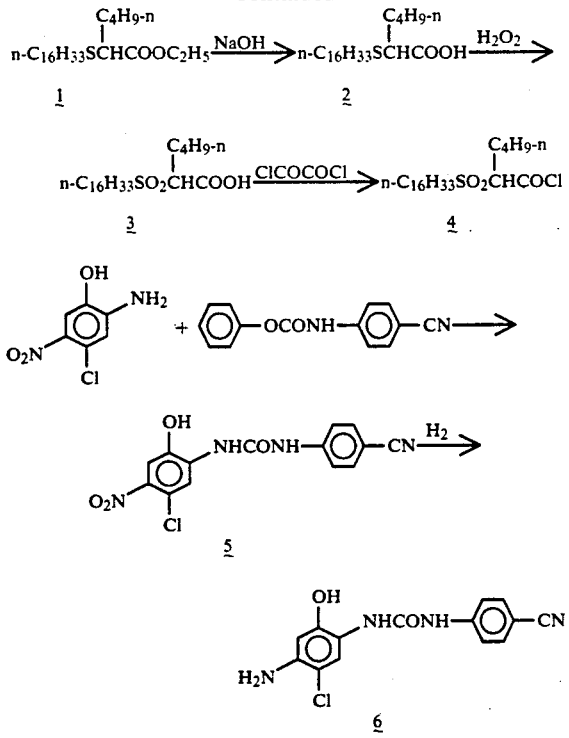

Synthesis of Intermediate 2

130 g (0.5 mol) of n-hexadecylmercaptane (commercially available reagent), 123 g (0.55 mol) of @-bromocapric acid ethyl ester, and 500 ml of ethyl alcohol were placed in a 2-liter three-necked flask equipped with a stirrer, and a solution of 25.0 g (0.55 mol) of 93% caustic soda in 100 g of water was added dropwise thereto at room temperature under a flow of nitrogen with stirring. After the addition, the stirring was continued for 4 hours, and then the solution was allowed to stand overnight. Then, 500 ml of tetrahydrofuran, 200 ml of methyl alcohol, and 43.0 g (1.0 mol) of 93% caustic soda were added, and after the mixture had been stirred for 1 hour at room temperature, white crystals separated out. The crystals were dissolved by heating, followed by neutralizing with hydrochloric acid, and then extraction with ethyl acetate was carried out. The extract was dehydrated by using anhydrous sodium sulfate, the solvent was removed, and recrystallization from n-hexane was carried out, to obtain 169 g (90% of theory) of white crystals of Intermediate 2.

Synthesis of Intermediate 3

55.9 g (0.15 mol) of Intermediate 2, 230 ml of acetic acid, and 0.6 g of sodium tungstate were placed in a 1-liter three-necked flask equipped with a stirrer, and 42.5 of (0.375 mol) of 31% hydrogen peroxide was added dropwise at room temperature with stirring. The reaction system dissolved with a liberation of heat and became clear. After the stirring was continued, a product separated out well. The product was dissolved by heating, and after insolubles were filtered off, 300 ml of acetonitrile was added to the solution followed by cooling. The separated crystals were filtered and were washed with acetonitrile, to obtain 49.4 g (81% of theory) of white crystals of Intermediate 3.

Synthesis of Intermediate 4

12.2 g (0.030 mol) of Intermediate 3 and 100 ml of methylene chloride that had been previously dried by molecular sieves were placed in a 200-ml three-necked flask equipped with a calcium chloride drying tube and a stirrer, and 5.2 ml (0.060 mol) of oxalyl chloride was added dropwise at room temperature with stirring. Thereafter, when 1 ml of N,N-dimethylformamide was added, bubbling was observed. Stirring was continued at room temperature for 1 hour, then insolubles were filtered off and the solvent was distilled off, to obtain 12.0 g (95% of theory) of a colorless oil of Intermediate 4. When it was allowed to stand, it turned to white crystals.

Synthesis of Intermediate 5

56.6 g (0.3 mol) of 4-chloro-5-nitro-2-aminophenol, 71.5 g (0.3 mol) of N-(p-cyanophenyl)phenyl carbamate, 2.4 g (0.03 mol) of imidazole, and 600 ml of acetonitrile were placed in a 1-liter three-necked flask equipped with a stirrer and a reflux condenser, and they were heated for 3 hours under reflux with stirring. After cooling the mixture to room temperature, its crystals were filtered and recrystallized from tetrahydrofuran-/acetone, to obtain 48.5 g (49% of theory) of yellow crystals of Intermediate 5.

Synthesis of Intermediate 6 and present Coupler Example C-21

10.0 g (0.03 mol) of Intermediate 5 and 200 ml of N,N-dimethylacetamide were placed in a 200-liter three-necked flask equipped with a magnetic stirrer and a hydrogen feeder, and they were dissolved at 40° C. 1.0 g of 10% palladium carbon catalyst was added thereto and hydrogenation was carried out at 40° C. under normal pressures with stirring. After 10 hours, the reaction was completed and the formation of Intermediate 6 was confirmed by thin-layer chromatography. To this reaction liquid, 12.1 g (0.03 mol) of Intermediate 4 was added. After stirring was continued for 1 hour, the catalyst was filtered off, extraction with ethyl acetate and washing with dilute hydrochloric acid were carried out, and the extract was purified by column chromatography using chloroform/ethyl acetate (3:1) as a developing solvent, to obtain 10.5 g (51% of theory) of a white solid of the present Coupler Example C-21. DI-EI mass spectrum: a parent peak was not observed; fragment peaks m/e=570, 544, 158, 144, 118, etc. This supported the aimed-for structure.

| | Elementary analysis | | |
|---|---|---|---|
| | H (%) | C (%) | N (%) |
| Calculated value | 7.75 | 62.72 | 8.13 |
| Observed value | 7.81 | 61.93 | 8.06 |
| | 7.84 | 61.59 | 7.90 |

The silver halide photographic material of the present invention has at least one layer containing a cyan coupler represented by formula (I) on a base. The layer containing the present cyan coupler may be a hydrophilic colloid layer on a base. The color photographic material generally comprises at least one blue-sensitive silver halide emulsion layer, at least one green-sensitive silver halide emulsion layer, and at least one red-sensitive silver halide emulsion layer, applied on a base in the stated order or in some other order. An infrared-sensitive silver halide emulsion may be used in place of at least one of the above photosensitive emulsion layers. By incorporating, in these photosensitive emulsion layers, silver halide emulsions having sensitivities in respective wavelength regions and color couplers capable of forming dyes complementary to light to which they are sensitive, color reproduction by the subtractive color process can be effected. However, the photosensitive emulsion layers and the color formed hues of the couplers may not have the above corresponding constitution. As the hydrophilic colloid layer containing the present cyan coupler on a base, these silver halide emulsion layers photosensitive in the visible or infrared region or their adjacent layers can be mentioned. In order to attain the objects of the present invention, a photosensitive silver halide emulsion layer is preferable and a red-sensitive silver halide emulsion layer is more preferable.

The amount of the cyan coupler of the present invention to be added is 0.002 to 5 mmol, preferably 0.01 to 2 mmol, per square meter.

The cyan couplers represented by formula (I) may be used alone or as a mixture of two or more of them in the present photographic material. A cyan coupler represented by formula (I) may be used as a mixture with other cyan couplers besides those represented by formula (I). In the latter case, preferably the proportion of the cyan coupler represented by formula (I) in all cyan couplers is 50 mol % or more, more preferably 75 mol % or more.

The cyan coupler of the present invention can be introduced into a photographic material by various known dispersion processes, for example, oil-in-water dispersion process, as described in U.S. Pat. No. 2,322,027, polymer dispersion process, as described in U.S. Pat. No. 4,199,363, West German Patent Application (OLS) Nos. 2,541,274 and 2,541,230, JP-B No.41091/1978, and European Patent Publication No. 029104, dispersion process by organic solvent-soluble polymer, as described in PCT International Publication No. WO 88/00723.

As the dispersion medium for the couplers, it is preferable to use a high-boiling organic solvent and/or a water-insoluble polymer compound having a dielectric constant of 2 to 20 (25° C.) and a refractive index of 1.5 to 1.7 (25° C.).

For the cyan coupler of the present invention, high-boiling organic solvents of phthalic acid esters (e.g., dibutyl phthalate and dioctyl phthalate), aliphatic esters (e.g., dibutoxyethyl succinate), and chlorinated parrafins are preferable.

As the high-boiling organic solvent, a high-boiling organic solvent represented by the following formula (A), (B), (C), (D), or (E) is preferably used.

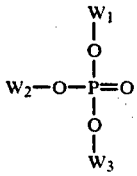

Formula (A)

$W_1-COO-W_2$ Formula (B)

-continued

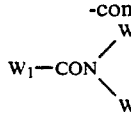

Formula (C)

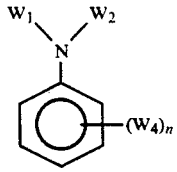

Formula (D)

$W_1-O-W_2$ Formula (E)

wherein $W_1$, $W_2$, and $W_3$ each represent a substituted or unsubstituted alkyl group, cycloalkyl group, alkenyl group, aryl group or heterocyclic group, $W_4$ represents $W_1$, $OW_1$ or $S-W_1$, n is an integer of 1 to 5, when n is 2 or over, $W_4$ groups may be the same or different, and in formula (E), $W_1$ and $W_2$ may together form a condensed ring.

Among these compounds, the high-boiling solvents represented by formula (B) and (C) are particularly preferable.

As the high-boiling organic solvent used in the present invention, any compound other than compounds represented by formulae (A) to (E) can also be used if the compound has a melting point of 100° C. or below and a boiling point of 140° C. or over, and if the compound is incompatible with water and is a good solvent for the coupler. Preferably the melting point of the high-boiling organic solvent is 80° C. or below. Preferably the boiling point of the high-boiling organic solvent is 160° C. or over, and more preferably 170° C. or over.

Details of these high-boiling organic solvents are described in JP-A No. 215272/1987, page 137 (the right lower column) to page 144 (the right upper column).

The couplers can also be emulsified and dispersed into an aqueous hydrophilic colloid solution by impregnating them into a loadable latex polymer (e.g., U.S. Pat. No. 4,203,716) in the presence or absence of the above-mentioned high-boiling organic solvent, or by dissolving them in a polymer insoluble in water and soluble in organic solvents.

Preferably, homopolymers and copolymers described in International Publication Patent No. WO 88/00723, pages 12 to 30, are used, and particularly the use of acrylamide polymers is preferable because, for example, dye images are stabilized.

The cyan coupler of the present invention is preferably dissolved in a high-boiling organic solvent (if needed, in the combination with a low-boiling organic solvent), then emulsified and dispersed in an aqueous solution of gelatin, and added to a silver halide emulsion. The weight ratio of the high-boiling organic solvent to the coupler may be 0 to 2.0 times, and preferably 0 to 1.0 times of coupler. The cyan coupler of the present invention can be dispersed stably, compared with other couplers, even by a high-boiling organic solvent of 0 to 0.1 times of coupler.

The cyan coupler of the present invention is preferably adapted to, for example, color paper, color reversal paper, direct positive color photographic material, color positive film, and color reversal film. Among them, it is preferably adapted to color photographic material having a reflection base (e.g., color paper and color reversal paper) and color photographic material to form a positive color image (e.g., direct positive color photographic material, color positive film, and color reversal film), particularly to color photographic material having a reflection base.

As the silver halide emulsion to be used in the present invention, can be used any composition of silver halide, such as silver iodobromide, silver iodochlorobromide, silver bromide, silver chlorobromide, and silver chloride.

Preferable composition of silver halide is different according to the kind of photographic material to be adapted, for example, a silver chlorobromide emulsion is used mainly for a color paper, a silver iodobromide emulsion is used for a color negative film of photographic purpose, and a silver bromide emulsion and a silver chlorobromide emulsion are used for a direct positive color photographic material. An emulsion, so-called high-silver chloride emulsion is preferably used for a photographic material of color paper that is suitable for a rapid processing.

In the present invention, one comprising silver chlorobromide or silver chloride and being substantially free from silver iodide can be preferably used. Herein the term "substantially free from silver iodide" means that the silver iodide content is 1 mol % or below, and preferably 0.2 mol % or below.

Although the halogen compositions of the emulsions may be the same or different from grain to grain, if emulsions whose grains have the same halogen composition are used, it is easy to make the properties of the grains homogeneous. With respect to the halogen composition distribution in a silver halide emulsion grain, for example, a grain having a so-called uniform-type structure, wherein the composition is uniform throughout the silver halide grain, a grain having a so-called layered-type structure, wherein the halogen composition of the core of the silver halide grain is different from that of the shell (which may comprise a single layer or layers) surrounding the core, or a grain having a structure with nonlayered parts different in halogen composition in the grain or on the surface of the grain (if the nonlayered parts are present on the surface of the grain, the structure has parts different in halogen composition joined onto the edges, the corners, or the planes of the grain) may be suitably selected and used. To secure high sensitivity, it is more advantageous to use either of the latter two than to use grains having a uniform-type structure, which is also preferable in view of the pressure resistance. If the silver halide grains have the above-mentioned structure, the boundary section between parts different in halogen composition may be a clear boundary, or an unclear boundary, due to the formation of mixed crystals caused by the difference in composition, or it may have positively varied continuous structures.

As to the halogen composition of silver chlorobromide emulsion, the content of silver chloride of the high-silver-chloride emulsion is 90 mol % or more, preferably 95 mol % or more. By making the content of silver chloride up to 90 mol % or more a color forming property at a rapid processing is improved, or a color-mix is surprisingly improved.

In these high-silver-chloride emulsions, the structure is preferably such that the silver bromide localized layer in the layered form or nonlayered form is present in the silver halide grain and/or on the surface of the silver halide grain as mentioned above. The silver bromide content of the composition of the above-mentioned localized layer is preferably at least 10 mol %, and more preferably over 20 mol %. The localized layer may be present in the grain, or on the edges, or corners of the grain surfaces, or on the planes of the grains, and a preferable example is a localized layer epitaxially grown on each corner of the grain.

On the other hand, for the purpose of suppressing the lowering of the sensitivity as much as possible when the photographic material undergoes pressure, even in the case of high-silver-chloride emulsions having a silver chloride content of 90 mol % or over, it is preferably also practiced to use grains having a uniform-type structure, wherein the distribution of the halogen composition in the grain is small.

In order to reduce the replenishing amount of the development processing solution, it is also effective to increase the silver chloride content of the silver halide emulsion. In such a case, an emulsion whose silver chloride is almost pure, that is, whose silver chloride content is 98 to 100 mol %, is also preferably used.

The average grain size of the silver halide grains contained in the silver halide emulsion used in the present invention (the diameter of a circle equivalent to the projected area of the grain is assumed to be the grain size, and the number average of grain sizes is assumed to be an average grain size) is preferably 0.1 to 2 μm.

Further, the grain size distribution thereof is preferably one that is a so-called monodisperse dispersion, having a deviation coefficient (obtained by dividing the standard deviation of the grain size by the average grain size) of 20% or below, and desirably 15% or below. In this case, for the purpose of obtaining one having a wide latitude, it is also preferable that monodisperse emulsions as mentioned above are blended to be used in the same layer, or are applied in layers.

As to the shape of the silver halide grains contained in the photographic emulsion, use can be made of grain in a regular crystal form, such as cubic, tetradecahedral, or octahedral, or grains in an irregular crystal form, such as spherical or planar, or grains that are a composite of these. Also, a mixture of silver halide grains having various crystal forms can be used. In the present invention, of these, grains containing grains in a regular crystal form in an amount of 50% or over, preferably 70% or over, and more preferably 90% or over, are preferred.

As the emulsion used in the present invention, use is made any of a so-called surface latent image-type emulsion, wherein a latent image is formed mainly on the grain surface, or of a so-called internal latent image-type emulsion, wherein a latent image is formed mainly within the grains.

The silver chloromide emulsion used in the present invention can be prepared by methods described, for example, in *I. Emulsion Preparation and Types*, in *Research Disclosure* (RD), No. 17643 (December 1978), pp. 22–23, and in ibid, No. 18716 (November 1979, p. 648; by P. Glafkides, in *Chimie et Phisique Photographique* (published by Paul Montel, 1967); by G. F. Duffin in *Photographic Emulsion Chemistry* (published by Focal Press, 1966), and by V. L. Zelikman et al. in *Making and Coating Photographic Emulsion* (published by Focal Press, 1964).

A monodisperse emulsion, such as described in U.S. Pat. Nos. 3,574,628 and 3,655,394, and in British Patent No. 1,413,748, is also preferable.

Tabular grains having an aspect ratio of 5 or greater can be used in the emulsion of this invention.

The silver halide emulsion used in the present invention is generally chemically sensitized and spectrally sensitized.

Into the silver halide emulsion used in the present invention, various polyvalent metal ion impurities can be introduced during the formation or physical ripening of the emulsion grains. Examples of such compounds to be used include salts of cadmium, zinc, lead, copper, and thallium, and salts or complex salts of an element of Group VIII, such as iron, ruthenium, rhodium, palladium, osmium, iridium, and platinum. Particularly the elements of Group VIII can be preferably used. Although the amount of these compounds to be added varies over a wide range according to the purpose, preferably the amount is $10^{-9}$ to $10^{-2}$ mol for the silver halide.

Additives for use in the physical ripening, chemical ripening, and spectral sensitizing process of a silver halide emulsion to be used in the present invention are described in Research Disclosure Nos. 17643, 18716, and 30715, and the involved sections are listed in the Table below. Known photographic additives that can be used in the present invention are also described in the above-mentioned three Research Disclosure, and the relating sections are listed in the same Table below.

| | Additive | RD 17643 | RD 18716 | RD 307105 |
|---|---|---|---|---|
| 1 | Chemical sensitizer | p. 23 | p. 648 (right column) | p. 866 |
| 2 | Sensitivity-enhancing agent | — | p. 648 (right column) | — |
| 3 | Spectral sensitizers and Supertabilizers | pp. 23–24 | pp. 648 (right column)–649 (right column) | pp. 866–868 |
| 4 | Brightening agents | p. 24 | p. 647 (right column) | p. 868 |
| 5 | Antifogging agents and Stabilizers | pp. 24–25 | p. 649 (right column) | pp. 868–870 |
| 6 | Light absorbers, Filter dyes, and UV Absorbers | pp. 25–26 | pp. 649 (right column)–650 (left column) | p. 873 |
| 7 | Stain-preventing agent | p. 25 (right column) | p. 650 (left to right column) | p. 872 |
| 8 | Image dye stabilizers | p. 25 | p. 650 (left column) | p. 872 |
| 9 | Hardeners | p. 26 | p. 651 (left column) | pp. 874–875 |
| 10 | Binders | p. 26 | p. 651 (left column) | pp. 873–874 |
| 11 | Plasticizers and Lubricants Lubricants | p. 27 | p. 650 (right column) | p. 876 |
| 12 | Coating aids and Surface-active agents | pp. 26–27 | p. 650 (right column) | pp. 875–876 |
| 13 | Antistatic agents | p. 27 | p. 650 (right column) | pp. 876–877 |
| 14 | Matting agent | — | — | pp. 878–879 |

Further, in order to prevent the lowering of photographic performances due to folmaldehyde gas, a compound described in, for example, U.S. Pat. Nos. 4,411,987 and 4,435,503 that is able to react with formaldehyde to immobilize it can be added to the photographic material.

Various color couplers can be used in this invention, and typical examples are described in the patents in the above-mentioned *Research Disclosure* No. 17643, VII-C to G.

Cyan couplers, magenta couplers, and yellow couplers preferably used in combination with the cyan coupler of the present invention are those represented by the following formulae (C-I), (C-II), (M-I), (M-II), and (Y). However, as regarding cyan couplers, the compound represented by formula (I) is preferably used 50 mol % or more of the total cyan couplers.

Formula (C-I)

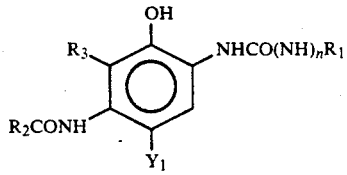

Formula (C-II)

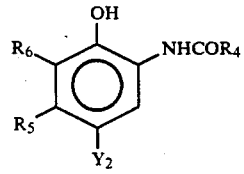

Formula (M-I)

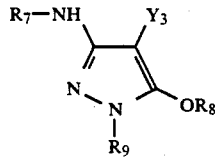

Formula (M-II)

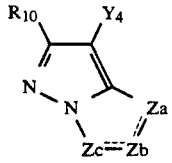

Formula (Y)

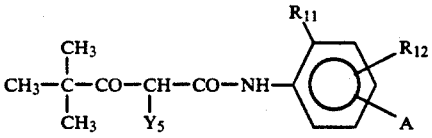

In formulae (C-I) and (C-II), $R_1$, $R_2$, and $R_4$ each represent a substituted or unsubstituted aliphatic, aromatic, or heterocyclic group, $R_3$, $R_5$, and $R_6$ each represent a hydrogen atom, a halogen atom, an aliphatic group, an aromatic group, or an acylamino group, $R_3$ and $R_2$ together may represent a group of nonmetallic atoms to form a nitrogen containing 5- or 6-membered ring, $Y_1$ and $Y_2$ each represent a hydrogen atom or a group that is capable of coupling off with the oxidation product of a developing agent, and n is 0 or 1.

In formula (C-II), $R_5$ preferably represents an aliphatic group such as a methyl group, an ethyl group, a propyl group, a butyl group, a pentadecyl group, a tertbutyl group, a cyclohexyl group, a cyclohexylmentyl group, a phenylthiomethyl group, a dodecyloxyphenylthiomethyl group, a butaneamidomethyl group, and a methoxymethyl group.

Preferable examples of the cyan couplers represented by formulae (C-I) and (C-II) are given below:

In formula (C-I), preferable $R_1$ is an aryl group or a heterocyclic group, and more preferably an aryl group substituted by a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group, or a cyano group.

In formula (C-I), when $R_3$ and $R_2$ together do not form a ring, $R_2$ is preferably a substituted or unsubstituted alkyl group, or aryl group, and particularly preferably an alkyl group substituted by a substituted aryloxy, and preferably $R_3$ represents a hydrogen atom.

In formula (C-II), $R_4$ is preferably a substituted or unsubstituted alkyl group or aryl group, and particularly preferably an alkyl group substituted by a substituted aryloxy group.

In formula (C-II), $R_5$ is preferably an alkyl group having 2 to 15 carbon atoms, or a methyl group substituted by a substituent having 1 or more carbon atoms, and the substituent is preferably an arylthio group, an alkylthio group, an acylamino group, an aryloxy group, or an alkyloxy group.

In formula (C-II), $R_5$ is preferably an alkyl group having 2 to 15 carbon atoms, and particularly preferably an alkyl group having 2 to 4 carbon atoms.

In formula (C-II), $R_6$ is preferably a hydrogen atom or a halogen atom, and particularly preferably a chlorine atom or a fluorine atom. In formulae (C-I) and (C-II), preferable $Y_1$ and $Y_2$ each represent a hydrogen atom, a halogen atom, an alkoxy group, an aryloxy group, an acyloxy group, or a sulfonamido group.

In formula (M-I), $R_7$ and $R_9$ each represent an aryl group, $R_8$ represents a hydrogen atom, an aliphatic or aromatic acyl group, an aliphatic or aromatic sulfonyl group, and $Y_3$ represents a hydrogen atom or a coupling split-off group. Allowable substituents of the aryl group represented by $R_7$ and $R_9$ are the same substituents as those allowable for the substituent $R_1$, and if there are two substituents, they may be the same or different. $R_8$ is preferably a hydrogen atom, an aliphatic acyl group, or a sulfonyl group, and particularly preferably a hydrogen atom. $Y_3$ is preferably of the type that will split-off at one of a sulfur atom, an oxygen atom, and a nitrogen atom, and particularly preferably of the sulfur atom split-off type described, for example, in U.S. Pat. No. 4,351,897 and International Publication Patent No. WO 88/04795.

In formula (M-II), $R_{10}$ represents a hydrogen atom or a substituent. $Y_4$ represents a hydrogen atom or a coupling split-off group, and particularly preferably a halogen atom or an arylthio group. Za, Zb, and Zc each represent methine, a substituted methine, =N-, or -NH-, and one of the Za-Zb bond and the Zb-Zc bond is a double bond, and the other is a single bond. If the Zb-Zc bond is a carbon-carbon double bond, it may be part of the aromatic ring. A dimer or more higher polymer formed through $R_{10}$ or $Y_4$ is included, and if Za, Zb, or Zc is a substituted methine, a dimer or more higher polymer formed through that substituted methine is included.

Of the pyrazoloazole couplers represented by formula (M-II), imidazo[1,2-b]pyrazoles described in U.S. Pat. No. 4,500,630 are preferable in view of reduced yellow subsidiary absorption of the color-formed dye and light-fastness, and pyrazolo[1,5-b][1,2,4] triazoles described in U.S. Pat. No. 4,540,654 are particularly preferable.

Further, use of pyrazolotriazole couplers wherein a branched alkyl group is bonded directly to the 2-, 3-, or 6-position of a pyrazolotriazole ring, as described in JP-A No. 65245/1976, pyrazoloazole couplers containing a sulfonamido group in the molecule, as described in JP-A No. 65246/1986, pyrazoloazole couplers having an alkoxyphenylsulfonamido ballasting group, as described in JP-A No. 147254/1986, and pyrazolotriazole couplers having an aryloxy group or an alkoxy group in the 6-position, as described in European Patent (Publication) Nos. 226,849 and 294,785, is preferable.

In formula (Y), $R_{11}$ represents a halogen atom, an alkoxy group, a trifluoromethyl group, or an aryl group, and $R_{12}$ represents a hydrogen atom, a halogen atom, or an alkoxy group. A represents $-NHCOR_{13}$, $-NHSO_2-R_3$, $-SO_2NHR_{13}$, $-COOR_{13}$, or $$-SO_2\underset{\underset{R_{14}}{|}}{N}-R_{13},$$

wherein $R_{13}$ and $R_{14}$ each represent an alkyl group, an aryl group, or an acyl group. $Y_5$ represents a coupling split-off group. Substituents of $R_{12}$, $R_{13}$, and $R_{14}$ are the same as those allowable for $R_1$, and the coupling split-off group $Y_5$ is of the type that will split off preferably at an oxygen atom or a nitrogen atom, and particularly preferably it is of the nitrogen atom split-off type.

Specific examples of couplers represented by formulae (C-I), (C-II), (M-I), (M-II) and (Y) are listed below.

(C'-1)

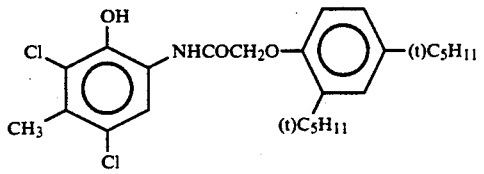

-continued
(C'-2)
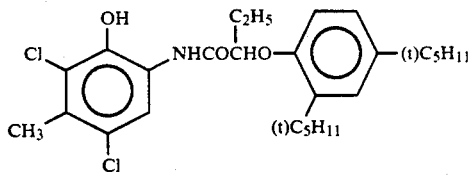
(C'-3)
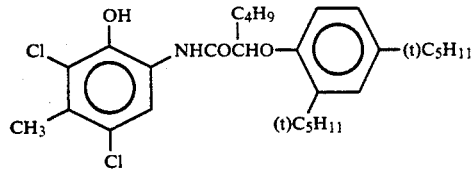
(C'-4)
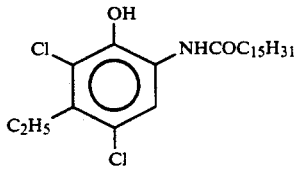
(C'-5)
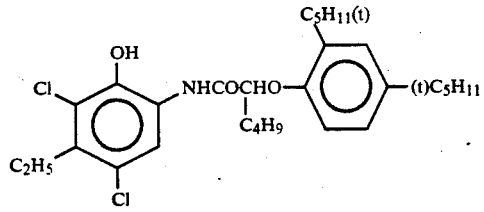
(C'-6)
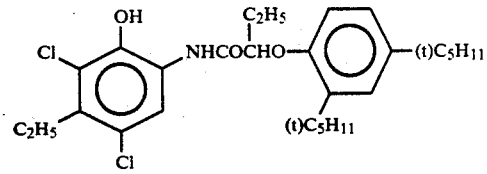
(C'-7)
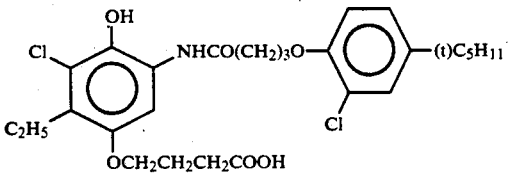
(C'-8)
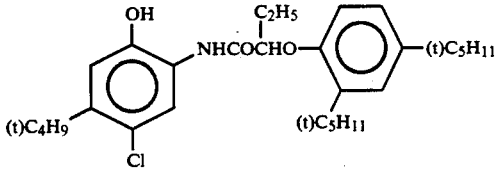
(C'-9)
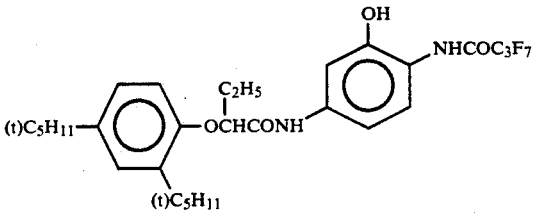

-continued
(C'-10)
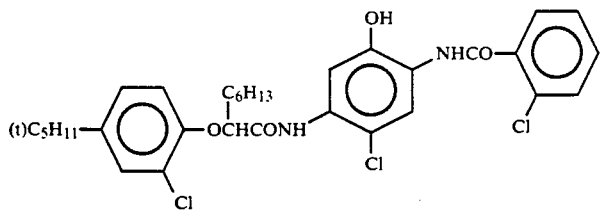
(C'-11)
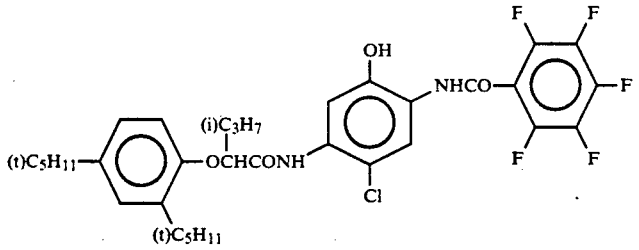
(C'-12)
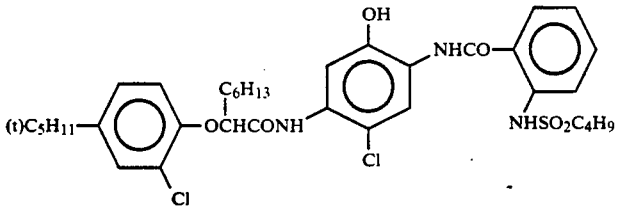
(C'-13)
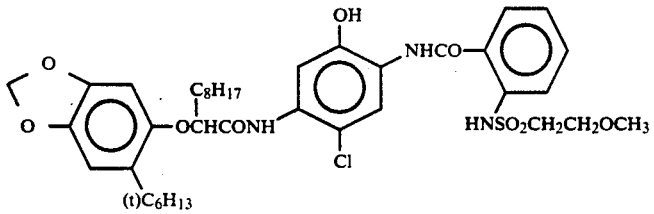
(C'-14)
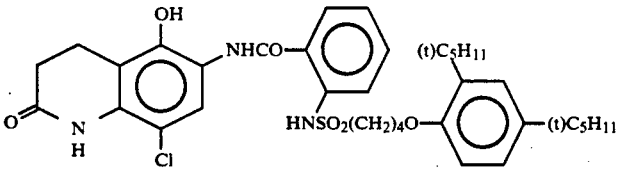
(C'-15)
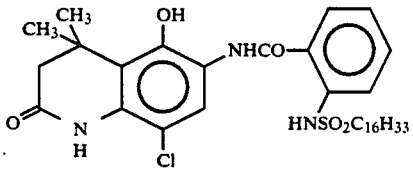
(C'-16)
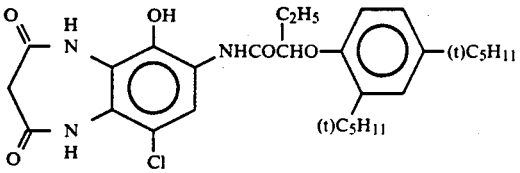

-continued
(C'-17)
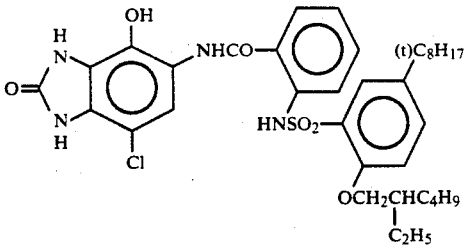
(C'-18)
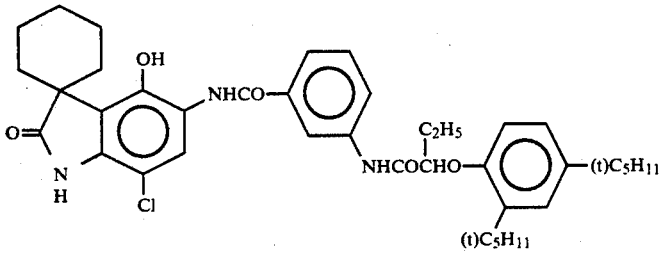
(C'-19)
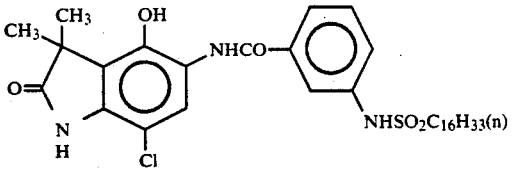
(C'-20)
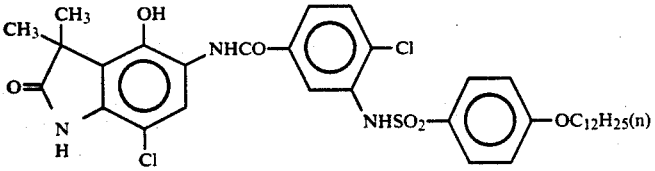
(C'-21)
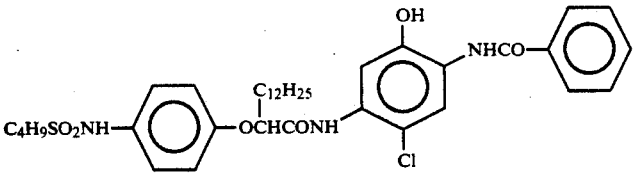
(C'-22)
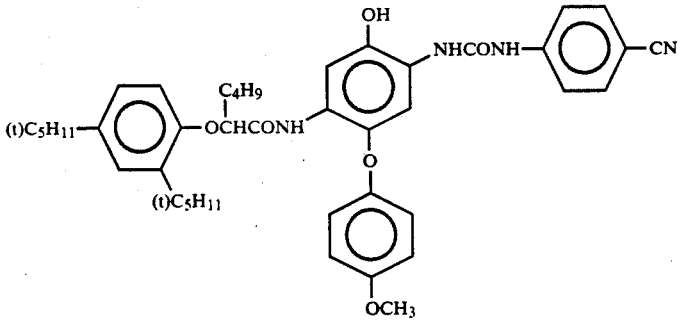

-continued
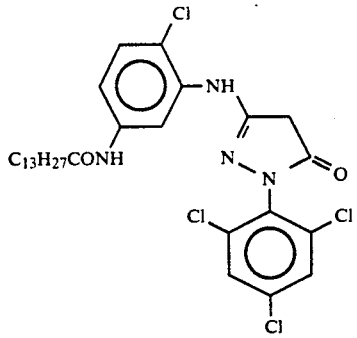
(M-1)
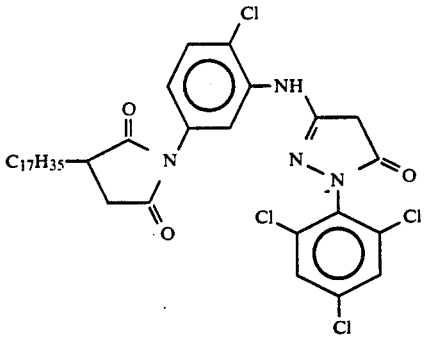
(M-2)
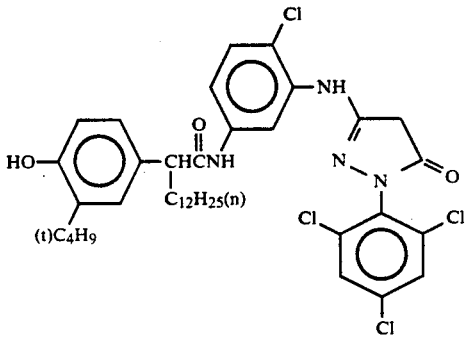
(M-3)
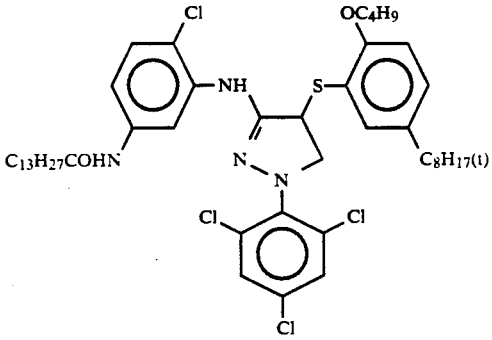
(M-4)

-continued
(M-5)
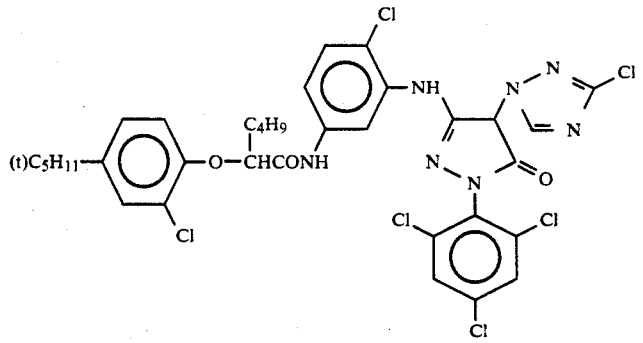
(M-6)
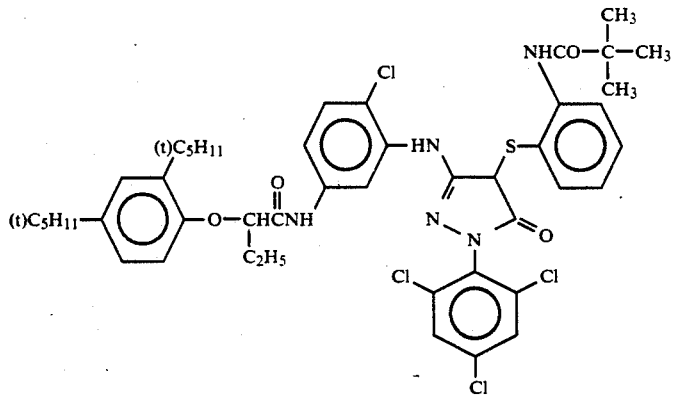
(M-7)
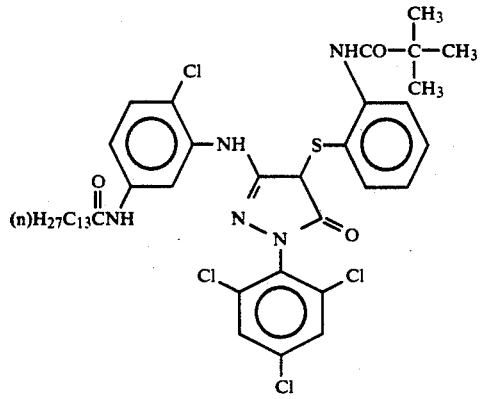
(M-8)
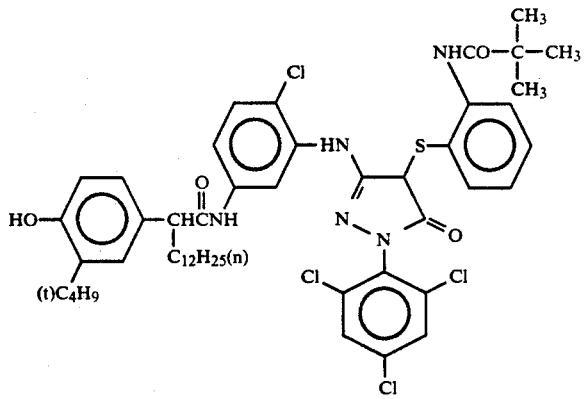

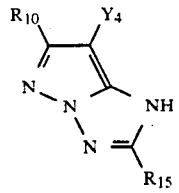
| Compound | $R_{10}$ | $R_{15}$ | $Y_4$ |
|---|---|---|---|
| M-9 | $CH_3$— | 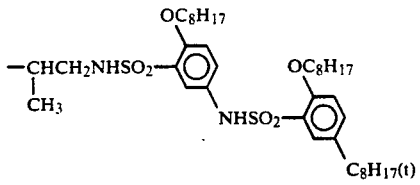 | Cl |
| M-10 | The same as the above | 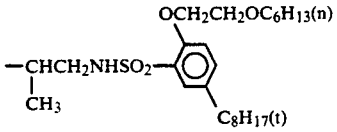 | The same as the above |
| M-11 | $(CH_3)_3C$— | 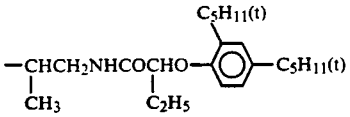 | 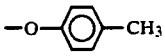 |
| M-12 | 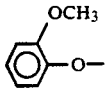 | 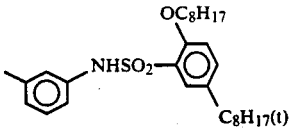 | 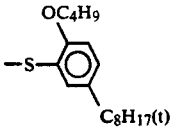 |
| M-13 | $CH_3$— | 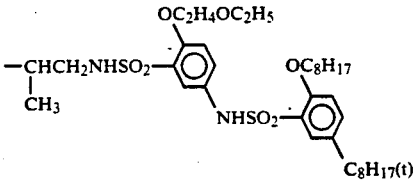 | Cl |
| M-14 | The same as the above | 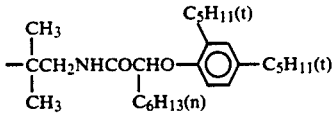 | The same as the above |
| M-15 | The same as the above | 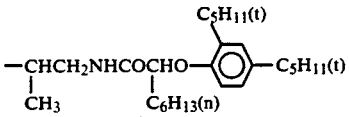 | The same as the above |
| M-16 | The same as the above | 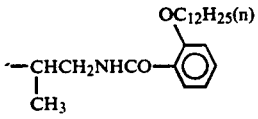 | The same as the above |
| M-17 | The same as the above | 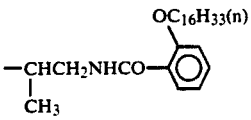 | The same as the above |

-continued
| | | | |
|---|---|---|---|
| M-18 | 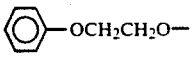 | 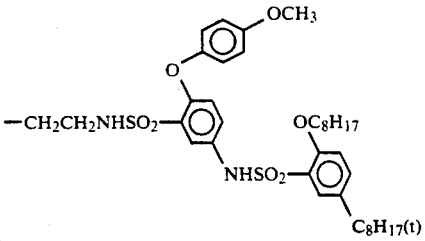 | 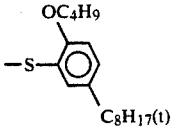 |
| M-19 | $CH_3CH_2O-$ | The same as the above | The same as the above |
| M-20 | 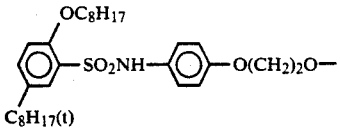 | 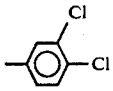 | 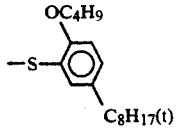 |
| M-21 | 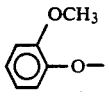 | 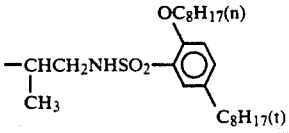 | Cl |
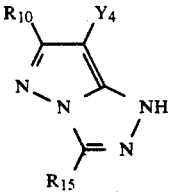
| Compound | $R_{10}$ | $R_{15}$ | $Y_4$ |
|---|---|---|---|
| M-22 | $CH_3-$ | 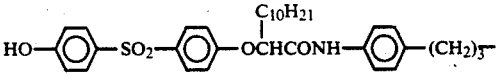 | Cl |
| M-23 | The same the above | 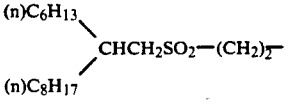 | The same as the above |
| M-24 | 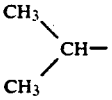 | 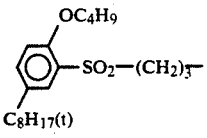 | The same as the above |
| M-25 | 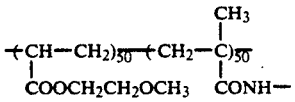 | 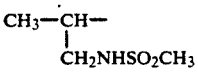 | The same as the above |
| M-26 | 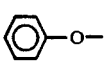 | 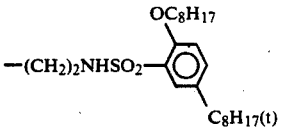 | The same as the above |
| M-27 | $CH_3-$ | 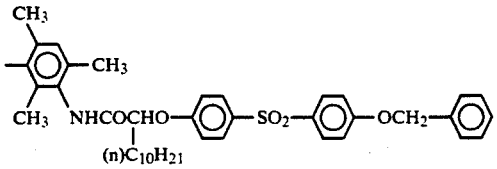 | Cl |

-continued
| | | | |
|---|---|---|---|
| M-28 | $(CH_3)_3C-$ | 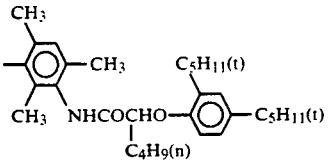 | The same as the above |
| M-29 | 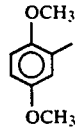 | 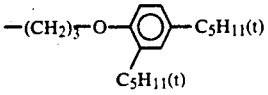 | The same as the above |
| M-30 | $CH_3-$ | 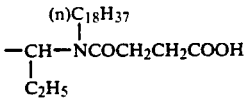 | The same as the above |
(Y-1)
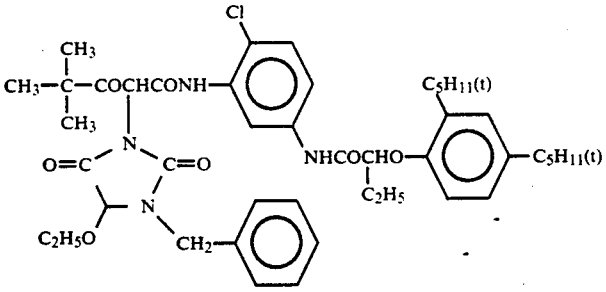
(Y-2)
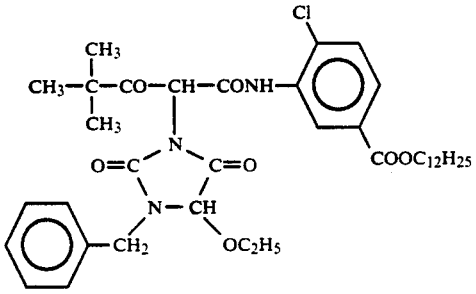
(Y-3)
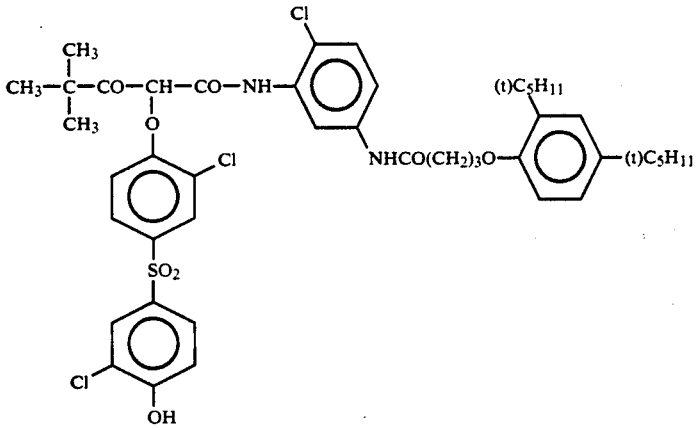

-continued
(Y-4)
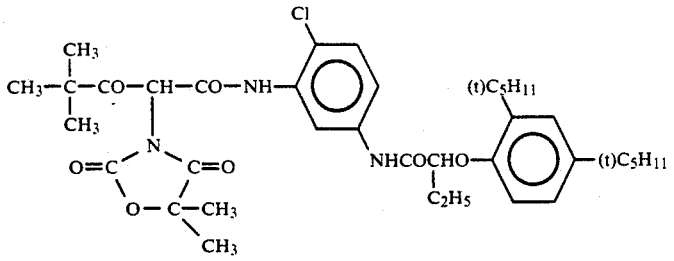
(Y-5)
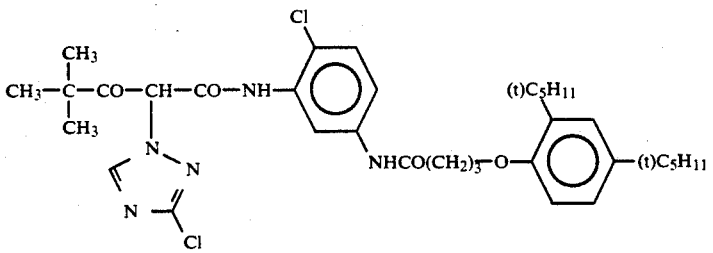
(Y-6)
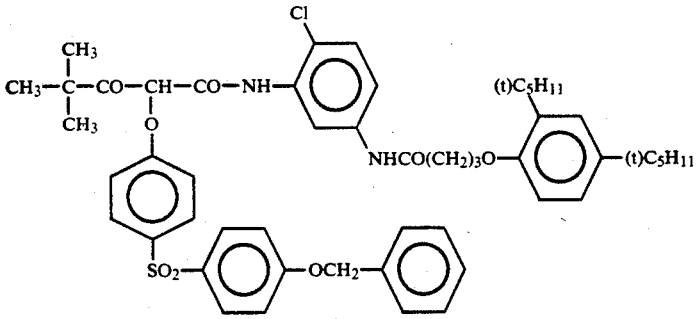
(Y-7)
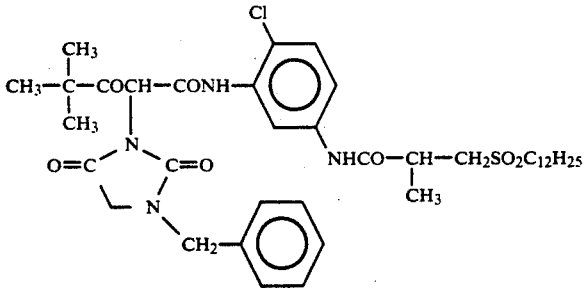
(Y-8)
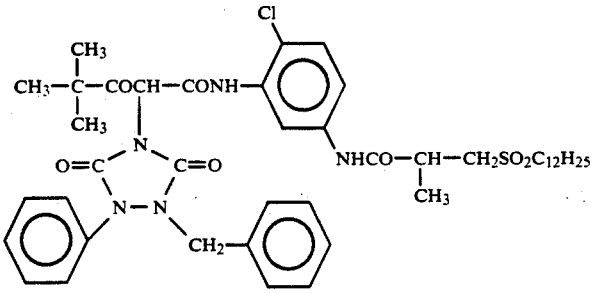

-continued (Y-9)

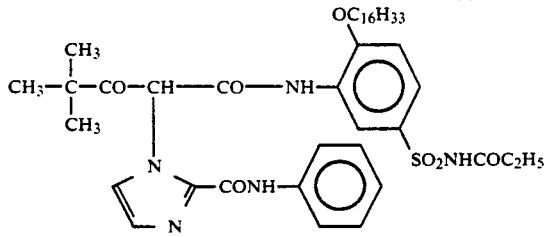

It is preferable to use the cyan coupler represented by formula (I) in combination with a magenta coupler represented by formula (M-1) or (M-2) and a yellow coupler represented by formula (Y). In particular, superior color reproduction not found conventionally can be attained by the combination use of these three couplers in a photosensitive layer provided on reflection base.

In this case, the magenta coupler is used usually 0.003 to 3.0 mol, preferably 0.015 to 1.5 mol, per mol of photosensitive silver halide, and the coating amount of the magenta coupler is 0.01 to 5 mmol, preferably 0.1 to 2 mmol per square meter of photographic material.

The yellow coupler is used usually 0.01 to 4.0 mol, preferably 0.05 to 2.0 mol, per mol of photosensitive silver halide, and the coating amount of the yellow coupler is 0.02 to 8.0 mmol, preferably 0.2 to 3.0 mmol, per square meter of photographic material.

Compounds represented by formula (M-II) are particularly preferably represented by the following formulae (M-IIa) and (M-IIb).

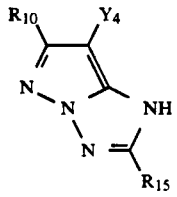

Formula (M-IIa)

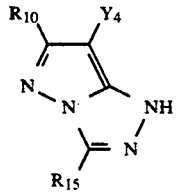

Formula (M-IIb)

wherein $R_{10}$ and $Y_4$ have the same meanings as $R_{10}$ and $Y_4$, and $R_{15}$ represents a hydrogen atom or a substituent.

The amount of color coupler usable in combination with the coupler of the present invention, as a standard, is 0.001 to 1 mol, preferably 0.01 to 0.5 mol as yellow coupler, 0.003 to 0.3 mol as magenta coupler, and 0.002 to 0.3 mol as cyan coupler, per mol of a photosensitive silver halide.

As additives able to be used in the photographic material of the present invention, can be mentioned, besides those mentioned in the above Research Disclosures, for example, oxonol dyes as described in European Patent No. 337,490A2; compounds improving image dye preservation as described in European Patent No. 277,589; antiseptics as described in JP-A No. 271247/1988 and 33144 1990, and European Patent No. 355,660, solvent for silver halide, chemical sensitizer; spectral sensitizer, emulsion stabilizer development accelerator, color coupler, color formation strengthening agent precursor, development restrainer, releasing compound, dye, gradation regulating agent, anti-stain agent, surface active agent, antistatic agent, coating aid, lubricant, adhesion preventing agent, binder, thickening agent, polymer latex, and matting agent. The dispersion method, base, photographic layer and composition are described in the above document.

As a base to be used in the present invention, a transparent film, such as cellulose nitrate film, and polyethylene terephthalate film or a reflection-type base that is generally used in photographic materials can be used. For the objects of the present invention, the use of a reflection-type base is more preferable.

The "reflection base" to be used in the present invention is one that enhances reflectivity, thereby making sharper the dye image formed in the silver halide emulsion layer, and it includes one having a base coated with a hydrophobic resin containing a dispersed light-reflective substance, such as titanium oxide, zinc oxide, calcium carbonate, and calcium sulfate, and also a base made of a hydrophobic resin containing a dispersed light-reflective substance. For example, there can be mentioned baryta paper, polyethylene-coated paper, polypropylene- type synthetic paper, a transparent base having a reflective layer, or additionally using a reflective substance, such as glass plate, polyester films of polyethylene terephthalate, cellulose triacetate, or cellulose nitrate, polyamide film, polycarbonate film, polystyrene film, and vinyl chloride resin.

The color developing agent represented by formula (D) will be described in detail.

$R^4$ in formula (D) represents a hydrogen atom, a halogen atom or methyl group, and when $R^4$ is a halogen atom it includes fluorine atom, chlorine atom, bromine atom, and iodine atom. $R^4$ is preferably methyl group.

$R^5$ and $R^6$ each represent methyl group or ethyl group, preferably $R^5$ is ethyl group and $R^6$ is methyl group.

L represents a methylene group or ethylene group and preferably L is an ethylene group.

Concrete examples of color developing agent represented by formula (D) are shown below.

D-1

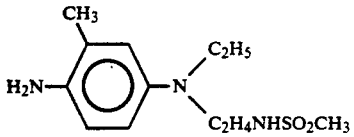

D-2

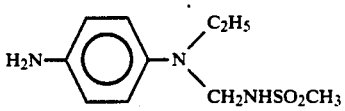

-continued

D-3

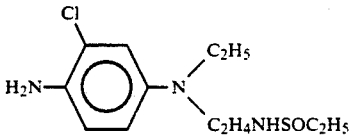

D-4

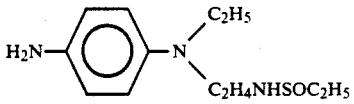

D-5

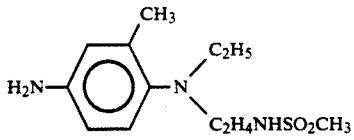

D-6

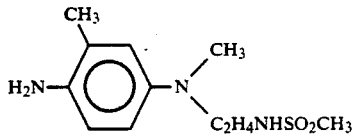

D-7

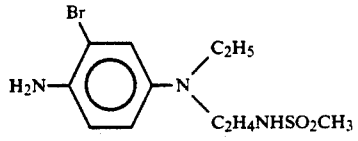

D-8

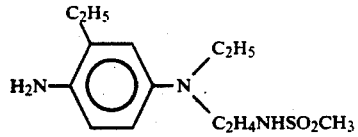

D-9

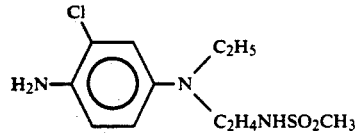

D-10

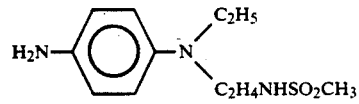

D-11

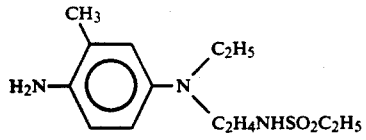

The most preferable color-developing agent in the present invention is a compound of D-1.

The aromatic primary amine color-developing agent represented by formula (D) is preferably produced by a method described in, for example, British Patent Nos. 651,749 and 651,909, U.S. Pat. No. 2,566,271 and the Journal of American Chemical Society 73, 3100 (1951).

The color-developing agent of the present invention may be compounds represented by formula (D) and their salts such as sulfates, hydrochloride, sulfites, and p-toluenesulfonates.

The amount of color-developing agent of the present invention to be used is preferably about 0.1 g to about 20 g, more preferably about 0.5 g to about 10 g, per liter of developer.

The color developer of the present invention is an alkaline solution the main component of which is the color-developing agent represented by formula (D).

Other aromatic primary amine developing agents may be incorporated at an amount not preventing the effects of the present invention.

Into the color developer ca be added pH buffer, such as carbonate of alkali metals, borate, and phosphate; chloride, aminetetraacetic acid, 1-hydroxyethylidene-1,1-diphosphonic acid, nitrilo-N,N,N-trimethylene-phosphonic acid, ethylenediamine-N,N,N,N-tetramethylene-phosphonic acid, and their salts; fluorescent brightening agent, such as 4,4'-diamino-2,2-disulfonstilbene series compound; surface active agent, such as alkylsulfonic acid, arylsulfonic acid, aliphatic carboxylic acid, and aromatic carboxylic acid.

In a color developer for print material, benzyl alcohol and diethyleneglycol (an auxiliary solvent for benzyl alcohol) have been used mainly in order to speed up the color dye formation. However, benzyl alcohol is not preferable because it brings a high BOD in the waste solution of processing. By this reason, benzyl alcohol has been excluded from color developers as a recent tendency in the art.

However, the exclusion of benzyl alcohol causes to slow down the color-developing speed, thus, it is in conflict with the need of rapid processing. As techniques to solve the problem, techniques of introduction of silver chloride emulsion and the reduction of sulfite ions in the processing solution excluding benzyl alcohol have been developed, accordingly the preservation of the environment and the speed up of the processing have been compatible.

In practicing the present invention, it is preferable to use a developer substantially free from benzyl alcohol. Herein the term "substantially free from" means that the concentration of benzyl alcohol is preferably 2 ml/l or below, and more preferably 0.5 ml/l or below, and most preferably benzyl alcohol is not contained at all.

It is more preferable that the developer used in the present invention is substantially free from sulfite ions. Sulfite ions serve as a preservative of developing agents, and at the same time have an action for dissolving silver halides, and they react with the oxidized product of the developing agent, thereby exerting an action to lower the dye-forming efficiency. It is presumed that such actions are one of causes for an increase in the fluctuation of the photographic characteristics. Herein the term "substantially free from" sulfite ions means that preferably the concentration of sulfite ions is $3.0\times10^{-3}$ mol/l or below, and most preferably sulfite ions are not contained at all. However, in the present invention, a quite small amount of sulfite ions used for the prevention of oxidation of the processing kit in which the developing agent is condensed is not considered.

Preferably, the color developer used in the present invention is substantially free from sulfite ions, and more preferably, in addition thereto it is substantially free from hydroxylamine. This is because hydroxylamine serves as a preservative of the developer, and at the same time has itself an activity for developing silver, and it is considered that the fluctuation of the concentration of hydroxylamine influences greatly the photographic characteristics. Herein the term "substantially free from hydroxylamine" means that preferably the concentration of hydroxylamine is $5.0\times10^{-3}$ mol/l or below, and most preferably hydroxylamine is not contained at all.

It is preferable that the developer used in the present invention contains an organic preservative instead of hydroxylamine or sulfite ions, in that process color-contamination and fluctuation of the photographic quality in continuous processing can be suppressed.

In the present invention, it is preferable that the color developer contains chloride ions in an amount of $3.5\times10^{-2}$ to $1.5\times10^{-1}$ mol/l, more preferably $4\times10^{-2}$ to $1\times10^{-1}$ mol/l in view of rapid development processing, color formation and the prevention of fogging.

In the present invention, the color developer contains bromide ions preferably in an amount of $3.0\times10^{-5}$ to $1.0\times10^{-3}$ mol/l in view of rapid development processing, color formation, sensitivity and the prevention of fogging. More preferably bromide ions are contained in an amount $5.0\times10^{-5}$ to $5.0\times10^{-4}$ mol/l.

Herein, chloride ions and bromide ions may be added directly to the developer, or they may be allowed to dissolve out from the photographic material in the developer.

If chloride ions are added directly to the color developer, as the chloride ion-supplying material can be mentioned sodium chloride, potassium chloride, ammonium chloride, lithium chloride, nickel chloride, magnesium chloride, manganese chloride, calcium, chloride, and cadmium chloride, with sodium chloride and potassium chloride preferred.

Chloride ions and bromide ions may be supplied from a brightening agent.

As the bromide ion-supplying material can be mentioned sodium bromide, potassium bromide, ammonium bromide, lithium bromide, calcium bromide, magnesium bromide, manganese bromide, nickel bromide, cadmium bromide, cerium bromide, and thallium bromide, with potassium bromide and sodium bromide preferred.

When chloride ions and bromide ions are allowed to dissolve out from the photographic material in the developer, both the chloride ions and bromide ions may be supplied from the emulsion or a source other than the emulsion.

Preferably the color developer used in the present invention has a pH of 9 to 12, and more preferably 9 to 11.0, and it can contain other known developer components.

In the present invention the processing temperature of color developing is generally about 20° to 50° C., and preferably about 30° to 45° C., and the processing time of color developing in generally 8 sec to 7 min, preferably 10 sec to 2 min, and more preferably 12 sec to 1 min.

The color photographic material of the present invention can provide a cyan dye image good in hue and high in color density having sharp absorption spectra curve, by the color developer of the present invention. Generally, the color photographic material of the present invention is subjected to, after color developing, desilvering process and water washing process.

In the desilvering process, instead of a bleaching process using a bleaching solution and a fixing process using a fixing solution, a bleach-fixing process may be carried out using a bleach-fixing solution and the arbitrary order of combination of a bleaching process, a fixing process and a bleach-fixing process can be used. A stabilizing process may be carried out instead of water-washing process or after water-washing. In combination with these processing processes, a prehardening process, a neutralizing process of said prehardening, a stop fixing process, a posthardening process, a compensating process, or an intensificating process can be provided. An arbitrary water-washing process may be provided between the above-mentioned processes.

In a color reversal developing process, generally, a bleach and white developing process, water-washing or rinsing process, and color developing process are carried out. In a reversal processing, a reversal bath containing a fogging agent may be used, and an optical reversal processing may be used. The reversal process may be omitted by incorporating the above fogging agent in the color developer.

Regarding processing process, color developing component other than the developing agent of the present invention, and other processing solution, those described in the above-mentioned Research Disclosures, JP-A Nos. 215272/1987 and 33144/1990, and European Patent No. 355,660A2 can be used.

According to the present invention, by a development processing of a 2-ureido-cyan coupler having a special ballast group at the 5-position represented by formula (I) using a color developer containing special color-developing agent represented by formula (D) a cyan color image having a maximum absorption wavelength and a hue represented by sharp absorption curve preferable to a photographic material for color print can be obtained. Therefore a color print excellent in color reproduction can be obtained.

Next, the present invention will be described in detail in accordance with examples, but the invention is not limited to these examples.

EXAMPLE 1

Monocolor photographic materials composed of two layers of an emulsion layer and a protective layer having compositions as shown below were prepared each on prime-coated cellulose triacetate supports. The figures provided indicate the coating amounts in g/m², except that the coating amount of coupler is shown in mol/m². The coating amount of silver halide emulsion is indicated in terms of silver.

Emulsion Layer

| | |
|---|---|
| Silver chlorobromide emulsions (silver chloride: 80 mol %, average grain size: 0.3 μm) silver | 0.8 |
| Gelatin | 1.2 |
| Coupler (see Table 1) (in mol/m²) | 0.001 |
| Dibutyl phthalate | 0.3 |

Protective Layer

| | |
|---|---|
| Gelatin | 0.9 |
| Poly(methyl methacrylate) particle (diameter: 1.5 μm) | 0.4 |
| Sodium 1-oxy-3,5-dichloro-s-triazinic acid | 0.04 |

Each sample was given gradation exposure to red light through a three color separated filter for sensitometry using a sensitometer (FWH model, manufactured by Fuji Photo Film Co., Ltd.; the color temperature of the light source: 3200° K.). At that time, exposure was effected such that the exposure time was 1/10 second and the exposure amount was 250 CMS.

After the exposure to light, each sample was subjected to a processing, the process of which is shown below using an automatic processor. The composition of each processing solution used is shown below.

| Processin process | Temperature | Time |
|---|---|---|
| Color-developing | 38° C. | 3 min. 30 sec. |
| Bleach-fixing | 38° C. | 1 min. 30 sec. |
| Water washing | 24–38° C. | 3 min. |
| Drying | 70–80° C. | 1 min. |

Compositions of each processing solution used were as follow:

| Color developer | |
|---|---|
| Water | 800 ml |
| Diethylenediaminepentaacetic acid | 1.0 g |
| Nitrilotriacetic acid | 2.0 g |
| Sodium sulfite | 0.2 g |
| Potassium bromide | 1.0 g |
| N-ethyl-N-(β-methanesulfonamidoethyl)-3-methyl-4-aminoaniline sulfonate | 4.5 g |
| Hydroxylamine sulfonate | 3.0 g |
| Fluorescent brightening agent (WHITEX 4B, manufactured by Sumitomo Chem. Co., Ltd) | 1.0 g |
| Water to make | 1000 ml |
| pH (25° C.) | 10.25 |

Bleach-Fixing Solution

| | |
|---|---|
| Water | 400 ml |
| Ammonium thiosulfite (70%) | 150 ml |
| Sodium bisulfite | 18 g |

-continued

| | |
|---|---|
| Fe(III) ammonium ethylenediamine-tetraacetic acide | 55 g |
| Disodium ethylenediaminetetraacetate | 5 g |
| Water to make | 1000 ml |
| pH (25° C.) | 6.70 |

Water Washing Solution

Ion-Exchanged Water (Calcium Ions and Magnesium Ions Each are 3 ppm or Less)

The thus-obtained cyan colored samples were measured an absorption spectrum at the part having density of 1, using a ultraviolet-visible spectrophotometer Type UV-260 provided an integral sphere, manufactured by Shimazu Seisakusho Co., Ltd.

Since the absorption shape of the cyan dye on the long wavelength side is not important to the hue of the cyan, the sharpness of the absorption shape was assessed in terms of the half-bandwidth on the short wavelength side, i.e., the wavelength difference between the maximum absorption wavelength and the wavelength on the short wavelength side that gives an absorbance of ½ of the absorbance at the maximum wavelength.

The above procedure was repeated, except that instead of 4.5 g N-ethyl-N-(β-methanesulfonamidoethyl)-3-methyl-4-aminoalinine sulfonate (hereinafter called color-developing agent A), which is a color-developing agent of the present invention, in the above color developer, 3.0 g of 4-amino-3-methyl-N-ethyl-N-(β-hydroxyethyl)aniline (hereinafter called color-developing agent B), which is a color-developing agent for negatives, was used, thereby assessing the absorption spectrum of the color formed cyan dye.

The results are shown in Table 1.

TABLE 1

| | | Color-developing agent A | | Color-developing agent B | | | | |
|---|---|---|---|---|---|---|---|---|
| No. | Coupler | Maximum absorption wavelength (nm) | Half-bandwidth on the short wavelength side (nm) | Maximum absorption wavelength (nm) | Half-bandwith on the short wavelength side (nm) | Degree of shortening wavelength (nm) | Degree of sharpening of absorption curve (nm) | Remarks |
| 1 | C-1 | 642 | 49 | — | — | 42 | 7 | This invention |
| 2 | | — | — | 684 | 56 | | | Comparative example |
| 3 | C-2 | 640 | 48 | — | — | 40 | 10 | This invention |
| 4 | | — | — | 680 | 58 | | | Comparative example |
| 5 | C-3 | 639 | 47 | — | — | 39 | 13 | This invention |
| 6 | | — | — | 688 | 60 | | | Comparative example |
| 7 | C-4 | 640 | 47 | — | — | 43 | 12 | This invention |
| 8 | | — | — | 684 | 59 | | | Comparative example |
| 9 | C-10 | 635 | 50 | — | — | 41 | 10 | This invention |
| 10 | | — | — | 676 | 60 | | | Comparative example |
| 11 | C-15 | 634 | 51 | — | — | 41 | 12 | This invention |
| 12 | | — | — | 675 | 63 | | | Comparative example |
| 13 | C-17 | 646 | 50 | — | — | 40 | 14 | This invention |
| 14 | | — | — | 686 | 64 | | | Comparative example |
| 15 | C-19 | 640 | 49 | — | — | 46 | 13 | This invention |
| 16 | | — | — | 686 | 62 | | | Comparative example |
| 17 | C-27 | 638 | 48 | — | — | 48 | 15 | This invention |
| 18 | | — | — | 686 | 63 | | | Comparative example |
| 19 | C-28 | 641 | 50 | — | — | 44 | 12 | This invention |
| 20 | | — | — | 685 | 62 | | | Comparative example |
| 21 | C-29 | 648 | 50 | — | — | 43 | 15 | This invention |
| 22 | | — | — | 691 | 65 | | | Comparative example |
| 23 | C-30 | 645 | 47 | — | — | 42 | 13 | This invention |
| 24 | | — | — | 687 | 60 | | | Comparative example |
| 25 | (i)* | 690 | 64 | — | — | −8 | −1 | Comparative example |
| 26 | | — | — | 682 | 63 | | | " |
| 27 | (ii)* | 671 | 57 | — | — | 13 | 1 | " |
| 28 | | — | — | 684 | 58 | | | " |
| 29 | (iii)* | 690 | 64 | — | — | −3 | −2 | " |
| 30 | | — | — | 687 | 62 | | | " |
| 31 | (iv)* | 669 | 58 | — | — | 15 | 2 | " |
| 32 | | — | — | 684 | 60 | | | " |

TABLE 1-continued

| No. | Coupler | Color-developing agent A: Maximum absorption wavelength (nm) | Color-developing agent A: Half-bandwidth on the short wavelength side (nm) | Color-developing agent B: Maximum absorption wavelength (nm) | Color-developing agent B: Half-bandwith on the short wavelength side (nm) | Degree of shortening wavelength (nm) | Degree of sharpening of absorption curve (nm) | Remarks |
|---|---|---|---|---|---|---|---|---|
| 33 | (v)* | 680 | 61 | — | — | 11 | −3 | " |
| 34 | | — | — | 691 | 58 | | | " |
| 35 | (vi)* | 688 | 65 | — | — | 7 | 1 | " |
| 36 | | — | — | 695 | 66 | | | " |
| 37 | (vii)* | 684 | 74 | — | — | 9 | −1 | " |
| 38 | | — | — | 693 | 73 | | | " |
| 39 | (viii)* | 649 | 63 | — | — | 9 | −1 | " |
| 40 | | — | — | 658 | 64 | | | " |
| 41 | (ix)* | 684 | 80 | — | — | 11 | 0 | " |
| 42 | | — | — | 695 | 80 | | | " |

Note:
*Comparative coupler

Comparative coupler (i):

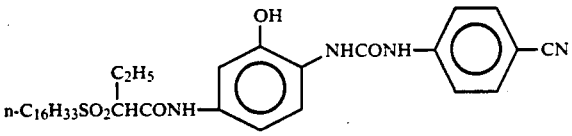

Comparative coupler (ii):

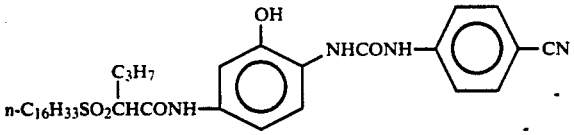

Comparative coupler (iii):
Exemplified coupler 1 in U.S. Pat. No. 4,775,616

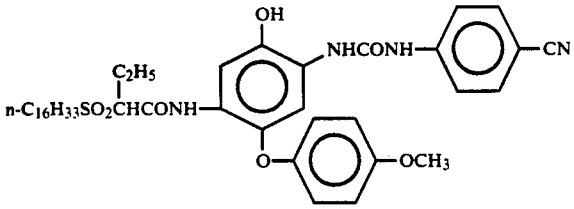

Comparative coupler (iv):
Exemplified coupler 1 in JP-A No. 13942/1990

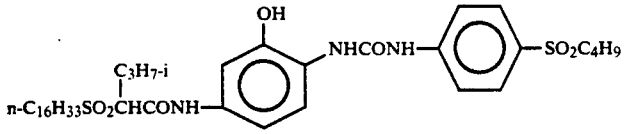

Comparative coupler (v):
Exemplified coupler 1 in JP-A No. 125252/1990

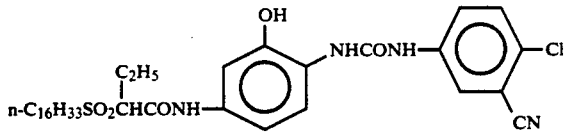

Comparative coupler (vi):
Exemplified coupler I-7 in JP-B No. 11656/1988

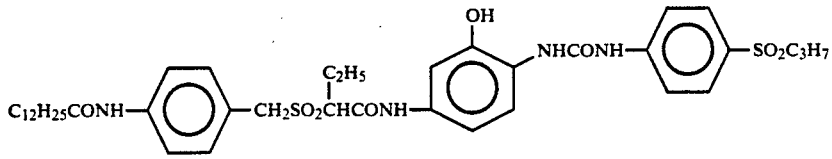

-continued

Comparative coupler (vii):
Exemplified coupler No. 7 in U.S. Pat. No. 4,333,999

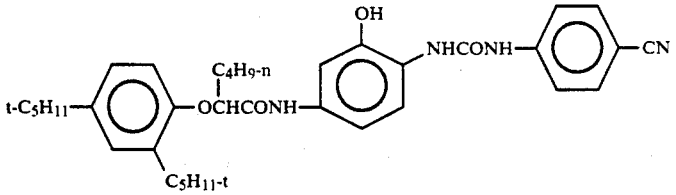

Comparative coupler (viii):
Included in U.S. Pat. No. 2,367,531

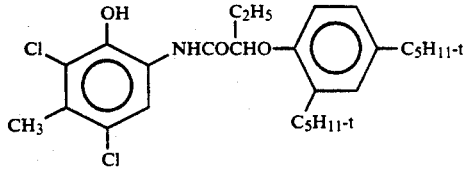

Comparative coupler (ix):
Included in U.S. Pat. No. 4,690,889

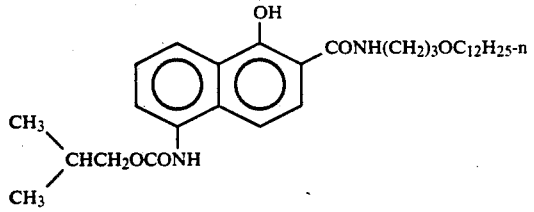

When a color photographic material containing a naphthol cyan coupler (Comparative Coupler (ix)) or a 2-ureido cyan coupler (Comparative Coupler (xii)) that is widely used conventionally in photographic materials for negatives is developed with a color developer for negatives containing color-developing agent B, the maximum wavelength of the produced cyan dye is a long wavelength, exceeding 680 nm, and the absorption shape is not sharp (Nos. 42 and 38). When that photographic material is developed with a color developer for prints containing color-developing agent A, although shortening of the maximum absorption wavelength of the cyan dye is recognized, it is on the order of 10 nm, and sharpening of the absorption shape cannot be substantially recognized (Nos 41 and 37). When color photographic materials containing 2-ureido cyan couplers (Comparative Couplers (iii), (iv), (v), and (vi)) having a ballasting group including a sulfonyl group at the 5-position, as disclosed in U.S. Pat. No. 4,775,616, JP-A Nos. 13942/1990 and 125252/1990, and JP-B No. 11656/1988 are developed with a color developer for negatives containing color-developing agent B (Nos. 30, 32, 34, and 36), the wavelength is long, and absorption shape is sharp in comparison with Nos. 42 and 38, and improved absorption properties as photographic materials for negatives are shown. However, when that color photographic material is developed with a color developer for prints containing color-developing agent A, the absorption of the cyan dye is at most about 15 nm, sharpening of the absorption shape is not recognized, and these 2-ureido cyan couplers do not provide a hue that can be used as a cyan coupler for prints (Nos. 29, 31, 33, and 35).

On the other hand, when the 2-ureido cyan coupler having, at the 5-position, a ballasting group having a specific structure containing a sulfonyl group is developed with a color developer for prints containing the present color-developing agent A (Nos. 1, 3, 5, 7, 9, 11, 13, 15, 17, 19, 21, and 23), in comparison with the case when developed with a color developer for negatives containing developing agent B, the maximum absorption wavelength of the cyan dye is shortened by as much as 40 to 50 nm, to a wavelength of 630 to 650 nm, which is a wavelength preferable for prints, and the absorption shape is sharpened by as much as 10 to 15 nm in terms of the half-bandwidth on the short wavelength side. Thus it can be understood that cyan dyes for prints of this invention are much better than those from the conventionally common cyan coupler, i.e., Comparative Coupler (viii) (No. 39).

Further, as is apparent by comparing Nos. 1, 3, 5, 7, 9, 11, 13, 17, 15, 19, and 23 with Nos. 25, 27, 29, 31, and 36, it can be understood that when color photographic materials containing 2-ureido cyan couplers of formula (I), wherein $R^2$ has 4 or more carbon atoms in total, are developed, particularly with a color developer containing a color-developing agent represented by formula (D), the above effects can be obtained that are not expected from the prior knowledge. In particular, this can be more clearly understood by comparing Coupler Example 1 (No.1) with Comparative Coupler (i) (No. 25) or Comparative Coupler (ii) (No. 27).

EXAMPLE 2

Exemplary of rapid development processing will be described blow.

Samples of photographic material (101 to 115) composed of two layers of an emulsion layer and a protective layer having compositions shown below were prepared each on a prime-coated cellulose triacetate supports. Figures representing coating amount are shown in terms of mol/$m^2$ for couplers providing that they are shown in g/m$^2$ for other components than coupler (for silver halides they are shown in terms of silver).

First Layer (Emulsion Layer)

| | |
|---|---|
| Silver chlorobromide emulsion (see Table 2) size: 0.3 μm) | 0.22 |
| Gelatin | 1.9 |
| Cyan coupler (see Table 2) | 0.001 |
| Dibutyl phthalate | 0.3 |

Second Layer (Intermediate Layer)

| | |
|---|---|
| Gelatin | 1.4 |

Third Layer (Yellow Coupler Layer)

| | |
|---|---|
| Gelatin | 1.9 |
| Yellow coupler ExY-1 | 0.001 |
| Dibutyl phthalate | 1.0 |

Fourth Layer (Protective Layer)

| | |
|---|---|
| Gelatin | 0.9 |
| Poly(methyl methacrylate) particle (diameter: 1.5 μm) | 0.4 |
| Sodium 1-oxy-3,5-dichloro-s-triazinic acid | 0.04 |

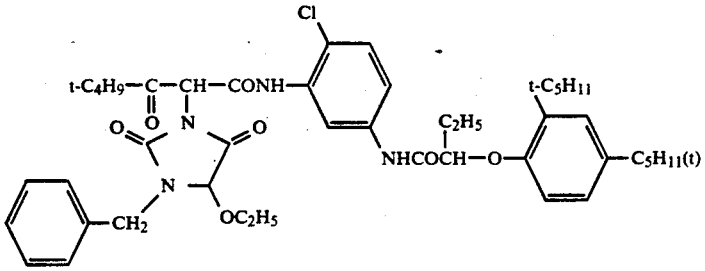

EXY-1

The thus-prepared color photographic materials (samples 201 to 214) were subjected to an exposure to light through an optical wedge having a continuous density and then to a color developing processing as shown below.

Color Developing Process (Temperature 35° C.)

Color Developing (as Will be Seen Later)

| | |
|---|---|
| Bleach-fixing | 45 sec. |
| Rinsing | 1 min. 30 sec. |
| Drying (70–80° C.) | 50 sec. |

Compositions of each processing solution used are described below.

Color Developer

| | |
|---|---|
| Water | 800 ml |
| Ethylenediamine-N,N,N,N-tetramethylene phosphonic acid | 1.5 g |
| Potassium bromide | 0.015 g |
| Triethanolamine | 8.0 g |
| Sodium chloride | 1.4 g |
| Potassium carbonate | 25 g |
| N-ethyl-N-(β-methanesolfonamidoethyl)-3-methyl-4-aminoaniline sulfate | 5.0 g |
| N,N-bis(carboxymethyl)hydrazine | 5.5 g |
| Fluorescent brightening agent (WHITEX 4B, manufactured by Sumitomo Chem. Co. Ltd.) | 1.0 g |
| Water to make | 1000 ml |
| pH (25° C.) | 10.05 |

Bleach-Fixing Solution

| | |
|---|---|
| Water | 400 ml |
| Ammonium thiosulfite (70%) | 100 ml |
| Sodium sulfite | 17 g |
| Fe(III) ammonium ethylenediamine-tetraacetate | 55 g |
| Disodium ethylenediaminetetraacetate | 5 g |
| Ammonium bromide | 40 g |
| Water to make | 1000 ml |
| pH (25° C.) | 6.0 |

Rinsing Solution

| |
|---|
| Ion-exchanged water (calcium ions and magnesium ions each are 3 ppm or less) |

The times of color-developing for samples 201, 203, 205, 207, 209, 211, and 213 each were 80 sec. and others were 40 sec.

After processing, colored samples were measured for densities of cyan and yellow, and the yellow density at the exposure amount giving the cyan density of 1.5 was determined and was represented by $D_Y$. Results are shown in Table 2.

TABLE 2

| Sample No. | Silver chloride content in silver halide of the emulsion (mol %) | Cyan coupler | $D_Y$ | Remarks |
|---|---|---|---|---|
| 201 | 80 | Comparative coupler A | 0.27 | Comparative example |
| 202 | 90 | Comparative coupler A | 0.38 | Comparative example |
| 203 | 80 | C-1 | 0.27 | This invention |
| 204 | 90 | C-1 | 0.22 | " |
| 205 | 80 | C-3 | 0.24 | " |

TABLE 2-continued

| Sample No. | Silver chloride content in silver halide of the emulsion (mol %) | Cyan coupler | Dy | Remarks |
|---|---|---|---|---|
| 206 | 90 | C-3 | 0.23 | " |
| 207 | 80 | C-4 | 0.23 | " |
| 208 | 90 | C-4 | 0.24 | " |
| 209 | 80 | C-13 | 0.24 | " |
| 210 | 90 | C-13 | 0.26 | " |
| 211 | 80 | C-31 | 0.24 | " |
| 212 | 90 | C-31 | 0.27 | " |
| 213 | 80 | Comparative coupler B | 0.26 | Comparative example |
| 214 | 90 | Comparative coupler B | 0.34 | Comparative example |

Comparative coupler A

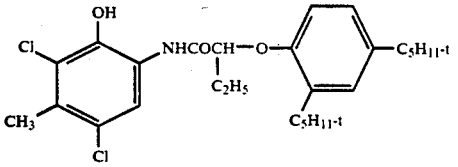

Comparative coupler B

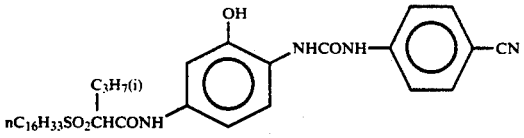

As is apparent from the results in Table 2, it can be understood that the value of $D_Y$ is low when the couplers represented by formula (I) of the present invention are used. In particular, when samples having a silver chloride content of 90% was processed in a short time, the increase of $D_Y$ of samples using couplers of the present invention were remarkably small. Although those of comparative samples 202 and 214 were large. From these results it can be noticed that the increase of color mix can be prevented by the combined use of a coupler represented by formula (I) of the present invention with an emulsion having 90% or more of silver chloride.

EXAMPLE 3

Samples 301 to 307 were prepared in the same manner as in Example 1, except that the silver chloride 80 mol % in the silver chlorobromide emulsion was changed to silver chloride 98 mol % and couplers were changed as shown in Table 3. After an imagewise exposure to light, these Samples 301 to 307 were subjected to the same processing in Example 2. The time of color developing was set at 30 sec. The thus-obtained colored samples were measured for absorption spectrum by the above-described spectrophotometer and the absorbance at 478 nm of the absorption spectrum of the respective sample whose absorbance at λmax is 1.0 was determined and designated as A470. These samples were stored at the conditions of 80° C. and 70% or low relative humidity for 3 days and the increase of absorbance at 470 nm was designated as ΔA470. A large ΔA470 means the increase of color contamination. Results are shown in Table 3.

TABLE 3

| Sample No. | Cyan coupler | Increment of yellow density Δ A470 | Remarks |
|---|---|---|---|
| 301 | Comparative coupler A | 0.15 | Comparative example |
| 302 | Comparative | 0.12 | Comparative |

TABLE 3-continued

| Sample No. | Cyan coupler | Increment of yellow density Δ A470 | Remarks |
|---|---|---|---|
| | coupler A | | example |
| 303 | C-1 | 0.06 | This invention |
| 304 | C-3 | 0.06 | " |
| 305 | C-4 | 0.07 | " |
| 306 | C-13 | 0.07 | " |
| 307 | C-31 | 0.10 | " |

As is apparent from the results in Table 3, it can be noticed that the color contamination in storage of image dye is proven by using couplers of the present invention. It was also found that, among couplers of the present invention, the color contamination of C-31 was not so large as those of the comparative couplers. It is noticed that this effect is due to partial structure of $R_2$ in the structure represented by formula (I) and the number of carbon atoms is preferably less than 12.

EXAMPLE 4

A multilayer photographic material (201) was prepared by multi-coatings composed of the following layer composition on a paper support which has been both sides polyethylene laminated and subjected to a corona discharge treatment followed by providing a subbing layer coated by gelatin containing sodium dodecylbenzenesulfonate. Coating solutions were prepared as follows:

Preparation of the First Layer Coating Solution

To a mixture of 19.1 g of yellow coupler (ExY), 4.84 g of image-dye stabilizer (Cpd-1) 0.7 g of image-dye stabilizer (Cpd-7), 27.2 ml of ethyl acetate and each 4.1 g of solvents (Solv-3) and (Solv-7) were added and dissolved. The resulting solution was dispersed and emulsified in 185 ml of 10% aqueous gelatin solution containing 8 ml of sodium dodecylbenzenesulfonate to obtain emulsified dispersion A. Separately silver chlorobromide emulsion A (cubic grains, 3:7 (silver mol ratio) blend of grains having a 0.88 μm and a 0.7 μm average grain size, and a 0.08 and a 0.10 deviation coefficient of grain size distribution, respectively, each in which 0.3 mol % of silver bromide was located at the surface of grains) was prepared. To this emulsion two kinds of blue-sensitive sensitizing dye A and B as shown were added in such amounts that each dye corresponds $2.0\times10^{-4}$ mol to the large size emulsion and $2.5\times10^{-4}$ mol to the small size emulsion, per mol of silver. The chemical ripening of this emulsion was conducted by adding sulfur sensitizing agent and gold sensitizing agent. The thus-prepared emulsion A and the above-obtained emulsified dispersion A were mixed together and dissolved to give the composition shown below, thereby preparing the first layer coating solution.

Coating solutions for the second to seventh layers were also prepared in the same manner as the first-layer coating solution. As a gelatin hardener for the respective layers, sodium salt of 1-oxy-3,5-dichloro-s-triazine was used.

To each layer Cpd-10 and Cpd-11 were added in such amount that respective total amount would be 25.0 mg/m² and 50.0 mg/m².

As spectral-sensitizing dyes for the silver chlorobromide emulsion in the respective layers, the following compounds were used:

Sensitizing dye A for blue-sensitive emulsion layer:

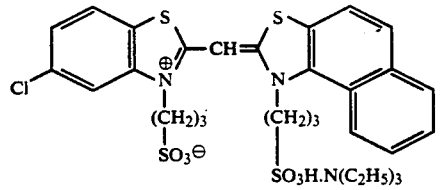

Sensitizing dye B for blue-sensitive emulsion layer:

-continued

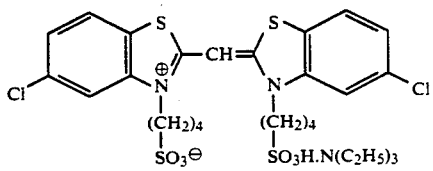

(each $2.0\times10^{-4}$ mol to the large size emulsion and $2.5\times10^{-4}$ mol to the small size emulsion, per mol of silver halide.)

Sensitizing dye C for green-sensitive emulsion layer:

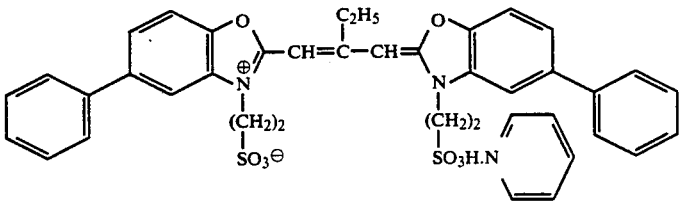

($4.0\times10^{-4}$ mol to the large size emulsion and $5.6\times10^{-4}$ mol to the small size emulsion, per mol of silver halide)

and Sensitizing dye D for green-sensitive emulsion

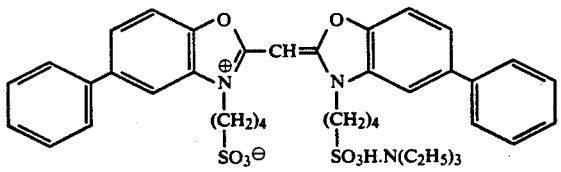

($7.0\times10^{-5}$ mol to the large size emulsion and $1.0\times10^{-5}$ mol to the small size emulsion, per mol of silver halide)

Sensitizing dye E for red-sensitive emulsion layer:

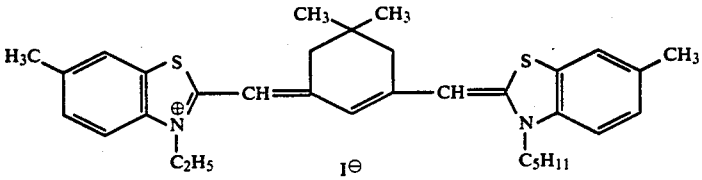

($0.9\times10^{-4}$ mol to the large size emulsion and $1.1\times10^{-4}$ mol to the small size emulsion, per mol of silver halide)

To the red-sensitive emulsion layer, the following compound was added in an amount of $2.6\times10^{-3}$ mol per mol of silver halide:

The following dyes were added to the emulsion were to prevent irradiation. (Figures in parentheses show each coating amount.)

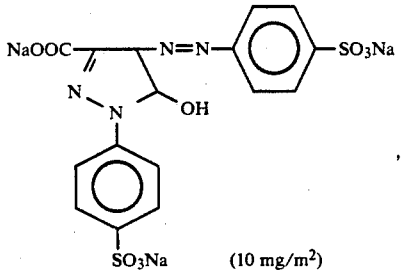

(10 mg/m²)

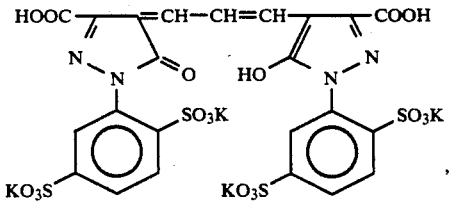

(10 mg/m²)

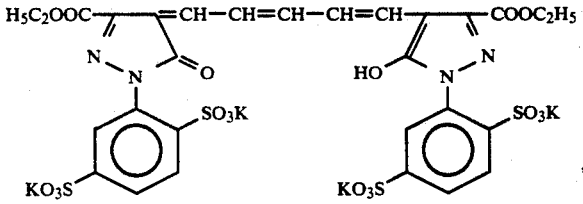

(40 mg/m²)

and

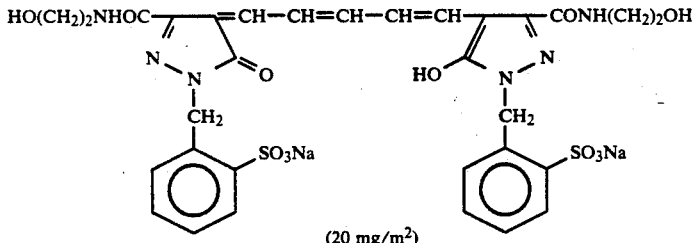

(20 mg/m²)

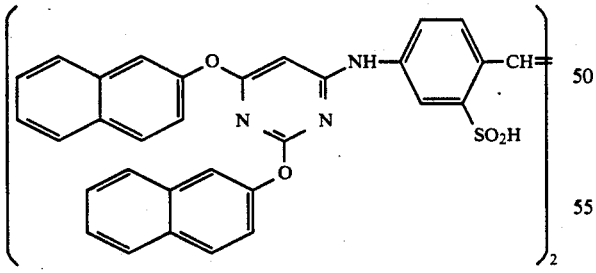

Further, 1-(5-methylureidophenyl)-5-mercaptotetrazole was added to the blue-sensitive emulsion layer, the green-sensitive emulsion layer, and the red-sensitive emulsion layer in amount of $8.5\times10^{-5}$ mol, $7.7\times10^{-4}$ mol, and $2.5\times10^{-4}$ mol, per mol of silver halide, respectively.

Further, to the blue-sensitive emulsion layer and the green-sensitive layer 4-hydroxy-6-methyl-1,3,3a,7-tetrazaubdebe was added in amounts of 1 z $10^{-4}$ mol and $2\times10^{-4}$ mol per mol of silver halide, respectively.

Composition of Layers

The composition of each layer is shown below. The figures represent coating amount (g/m²). The coating amount of each silver halide emulsion is given in terms of silver.

Supporting Base

Paper Laminated on Both Sides with Polyethylene (a White Pigment, $TiO_2$, and a Bluish Dye, Ultramarine, were Included in the First Layer Side of the Polyethylene-Laminated Film)

First Layer (Blue-Sensitive Emulsion Layer)

| | |
|---|---|
| The above-described silver chlorobromide emulsion A | 0.30 |
| Gelatin | 1.80 |
| Yellow coupler (ExY-1) | 0.82 |
| Image-dye stabilizer (Cpd-1) | 0.19 |
| Solvent (Solv-3) | 0.18 |

-continued

| | |
|---|---|
| Solvent (Solv-7) | 0.18 |

Second Layer (Color-Mix Preventing Layer)

| | |
|---|---|
| Gelatin | 0.99 |
| Color mix inhibitor (Cpd-5) | 0.08 |
| Solvent (Solv-1) | 0.16 |
| Solvent (Solv-4) | 0.08 |

Third Layer (Green-Sensitive Emulsion Layer)

| | |
|---|---|
| Silver chlorobromide emulsions (cubic grains, 1:3 (Ag mol ratio) blend of grains having a 0.55 μm and a 0.39 μm average grain size, and a 0.10 and a 0.08 deviation coefficient of grain size distribution, respectively, each in which 0.8 mol % of AgBr was located at the surface of grains) | 0.12 |
| Gelatin | 1.24 |
| Magenta coupler (ExM) | 0.23 |
| Image-dye stabilizer (Cpd-2) | 0.03 |
| Image-dye stabilizer (Cpd-3) | 0.16 |
| Image-dye stabilizer (Cpd-4) | 0.02 |
| Image-dye stabilizer (Cpd-9) | 0.02 |
| Solvent (Solv-2) | 0.40 |

Fourth Layer (Ultraviolet Absorbing Layer)

| | |
|---|---|
| Gelatin | 1.58 |
| Ultraviolet absorber (UV-1) | 0.47 |
| Color-mix inhibitor (Cpd-5) | 0.05 |
| Solvent (Solv-5) | 0.24 |

Fifth Layer (Red-Sensitive Emulsion Layer)

| | |
|---|---|
| Silver chlorobromide emulsions (cubic grains, 1:4 (Ag mol ratio) blend of grains having a 0.58 μm and a 0.45 μm average grain size, and a 0.09 and a 0.11 deviation coefficient of grain size distribution, respectively, each in which 0.6 mol % of AgBr was located at the surface of grains) | 0.23 |
| Gelatin | 1.34 |
| Cyan coupler C-1 | 0.001 (mol/m$^2$) |
| Image-dye stabilizer (Cpd-2) | 0.03 |

-continued

| | |
|---|---|
| Image-dye stabilizer (Cpd-4) | 0.02 |
| Image-dye stabilizer (Cpd-6) | 0.18 |
| Image-dye stabilizer (Cpd-7) | 0.40 |
| Image-dye stabilizer (Cpd-8) | 0.05 |
| Solvent (Solv-6) | 0.14 |

Sixth Layer (Ultraviolet Ray Absorbing Layer)

| | |
|---|---|
| Gelatin | 0.53 |
| Ultraviolet absorber (UV-1) | 0.16 |
| Color-mix inhibitor (Cpd-5) | 0.02 |
| Solvent (Solv-5) | 0.08 |

Seventh Layer (Protective Layer)

| | |
|---|---|
| Gelatin | 1.33 |
| Acryl-modified copolymer of polyvinyl alcohol (modification degree: 17%) | 0.17 |
| Liquid paraffin | 0.03 |

Samples 202 to 212 were prepared in the same manner as sample 201, except that the cyan coupler C-1j of sample 201 was changed to cyan coupler C-2, C-3, C-4, C-10, C-15, C-17, C-19, C-27, C-28, C-29, and C-30, respectively Compounds used are as follows:

(ExY) Yellow coupler
Mixture (1:1 in molar ratio) of

R =

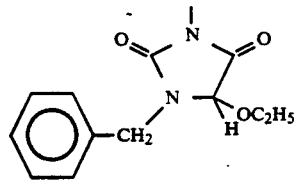

and

R =

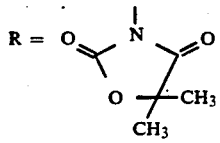

of the following formula

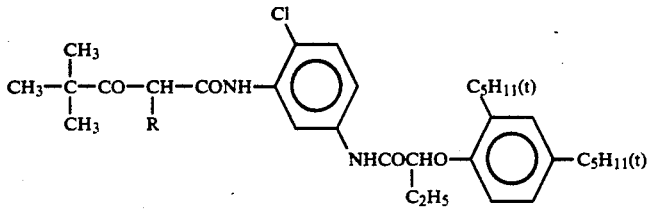

(ExM) Magenta coupler

-continued
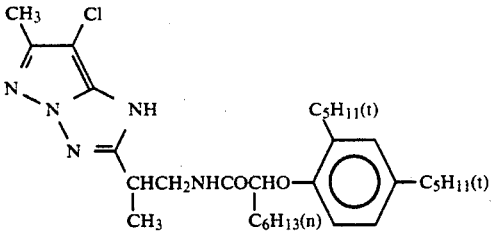
(Cpd-1) Image-dye stabilizer
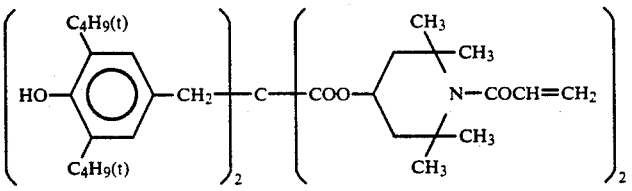
(Cpd-2) Image-dye stabilizer
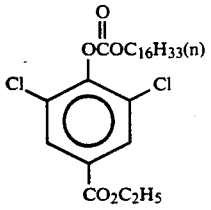
(Cpd-3) Image-dye stabilizer
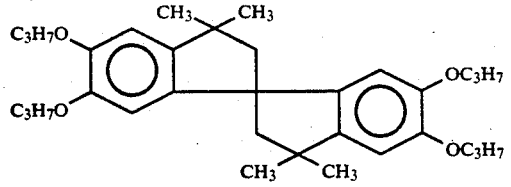
(Cpd-4) Image-dye stabilizer
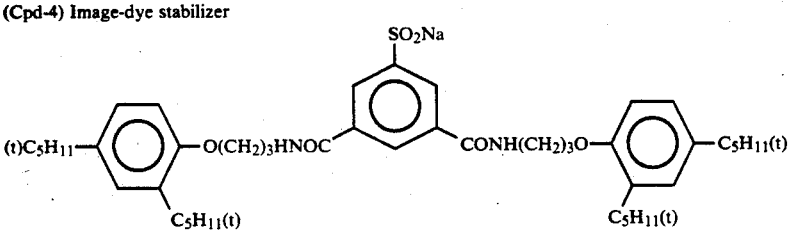
(Cpd-5) Color-mix inhibitor
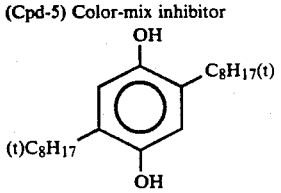
(Cpd-6) Image-dye stabilizer
Mixture (2:4:4 in weight ratio) of
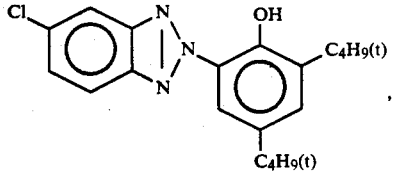

-continued
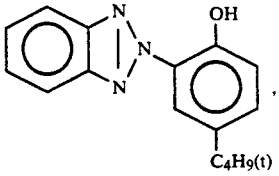
and
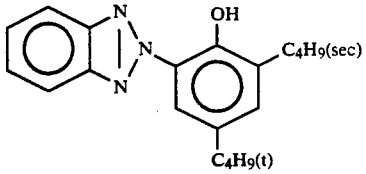
(Cpd-7) Image-dye stabilizer
$$\left(CH_2-\underset{\underset{CONHC_4H_9(t)}{|}}{CH}\right)_n$$
Average molecular weight: 60,000
(Cpd-8) Image-dye stabilizer
Mixture (1:1 in weight ratio) of
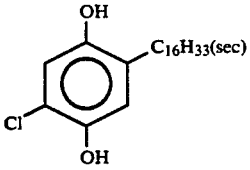
and
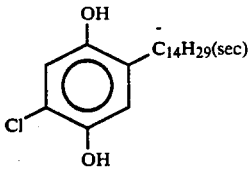
(Cpd-9) Image-dye stabilizer
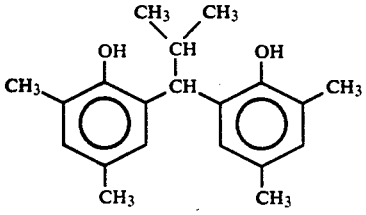
(Cpd-10) Antiseptics
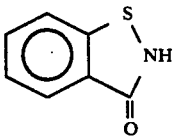
(Cpd-11) Antiseptics
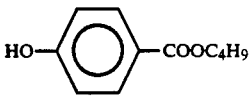
(UV-1) Ultraviolet ray absorber
Mixture (4:2:4 in weight ratio) of
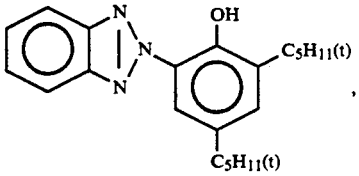

-continued

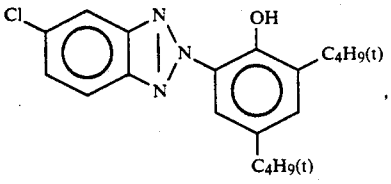

and

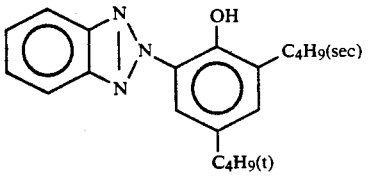

(Solv-1) Solvent

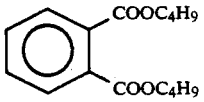

(Solv-2) Solvent
Mixture (1:1 in volume ratio) of

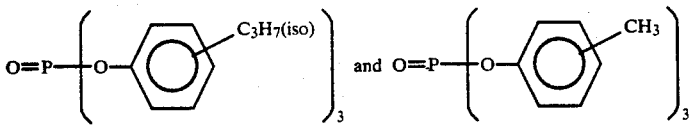

(Solv-3) Solvent
$O{=}P{+}O{-}C_9H_{19}(iso)]_3$ (Solv-4) Solvent

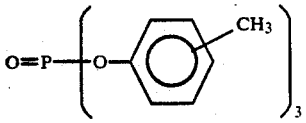

(Solv-5) Solvent

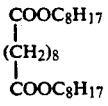

(Solv-6) Solvent
Mixture (80:20 in volume ratio) of

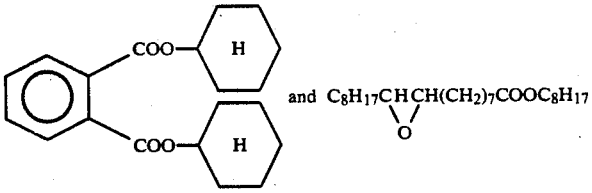

(Solv-7) Solvent

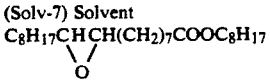

Then, these photographic papers were given an exposure of red light through a wedge of continuous gradation.

After the exposure of the above Photographic Materials, they were continuously processed (running test) by using a paper processor in the following processing steps until the replenishing amount reached a point twice the amount of the tank volume for color development.

| Processing steps | Temperature | Time | Replenisher Amount* | Tank Volume |
|---|---|---|---|---|
| Color Developing | 35° C. | 45 sec. | 161 ml | 17 litters |
| Bleach-fixing | 30–35° C. | 45 sec. | 215 ml | 17 litters |
| Rinsing 1 | 30–35° C. | 20 sec. | — | 10 litters |
| Rinsing 2 | 30–35° C. | 20 sec. | — | 10 litters |
| Rinsing 3 | 30–35° C. | 20 sec. | 350 ml | 10 litters |

-continued

| Processing steps | Temperature | Time | Replenisher Amount* | Tank Volume |
|---|---|---|---|---|
| Drying | 70–80° C. | 60 sec. | | |

Note:
*Replenisher amount is shown in ml per $m^2$ of photographic material.
Rinsing steps were carried out in 3-tanks counter-flow mode from the tank of rinsing 3 towards the tank of rinsing 1.
The opened surface ratio was changed by changing the size of floating lid.

The compositions of each processing solution were as follows:

| Color developer | Tank Solution | Replenisher |
|---|---|---|
| Water | 800 ml | 800 ml |
| Ethylenediamine-N,N,N,N-tetramethylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-ethyl-N-(β-methanesulfonamidoethyl)-3-methyl-4-aminoaniline sulfonate | 5.0 g | 7.0 g |
| N,N-bis(carboxymethyl)hydrazine | 5.5 g | 7.0 g |
| N,N-di(sulfoethyl)hydroxylamine.1Na | 4.0 g | 5.0 g |
| Fluorescent brightening agent (WHITEX-4, made by Sumitomo Chemical Ind. Co.) | 1.0 g | 2.0 g |
| Water to make | 1000 ml | 1000 m |
| pH (25° C.) | 10.05 | 10.45 |

Bleach-Fixing Solution

Both Tank Solution and Replenisher

| | |
|---|---|
| Water | 400 ml |
| Ammonium thiosulfate (70%) | 100 ml |
| Sodium sulfite | 17 g |
| Iron (III) ammonium ethylenediaminetetraacetate dihydrate | 55 g |
| Disodium ethylenediaminetetraacetate | 5 g |
| Ammonium bromide | 40 g |
| Water to make | 1000 ml |
| pH (25° C.) | 6.0 |

Rinsing Solution

Both Tank Solution and Replenisher

Ion-Exchanged Water (Calcium and Magnesium Each are Contained in an Amount of 3 ppm or Below)

The hue of cyan dye of thus-obtained cyan colored sample was evaluated in the same manner as Example 1.

Samples 201 to 212 of each multilayer color photographic material prepared by using cyan coupler of the present invention gave cyan hues preferable to color photographic paper by developing using a color developer containing a color developing agent of the present invention.

Having described our invention as related to the present embodiments, it is our intention that the invention not be limited by any of the details of the description, unless otherwise specified, but rather be construed broadly within its spirit and scope as set out in the accompanying claims.

What we claim is:

1. A method for forming a color image, which comprises imagewise exposing to light and then developing a silver halide color photographic material having at least one layer containing a cyan coupler represented by the following formula (I):

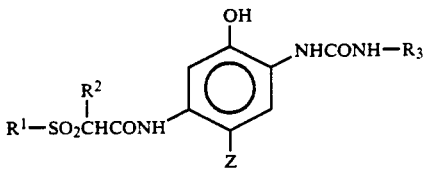

Formula (I)

wherein $R^1$ represents an alkenyl group, or a cycloalkyl group, $R^2$ represents an alkyl group having a total C-number of 4 to 30, an alkenyl group having a total C-number of 4 to 30, or a cycloalkyl group having a total C-number of 4 to 30, $R^3$ represents an aryl group, and Z represents a hydrogen atom or a group capable of being released upon a coupling reaction, with a color developer containing a color-developing agent represented by the following formula (D):

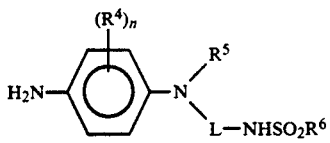

Formula (D)

wherein $R^4$ represents a hydrogen atom, a halogen atom, or a methyl group, $R^5$ and $R^6$ each represent a methyl group or an ethyl group, L represents a methylene group or an ethylene group, and n is 1 or 2.

2. The method for forming a color image as claimed in claim 1, wherein at least one silver halide emulsion of the silver halide color photographic material contains a silver halide comprising 90 mol % or more of silver chloride.

3. The method for forming a color image as claimed in claim 1, wherein $R^1$ in formula (I) represents a linear or branched alkyl group that may be substituted and has a total C-number of 1 to 30, a linear or branched alkenyl group that may be substituted and has a total C-number of 2 to 30, or a 3- to 12-membered cycloalkyl group that may be substituted and has a total C-number of 3 to 30.

4. The method for forming a color image as claimed in claim 1, wherein $R^2$ in formula (I) represents a linear or branched alkyl group that may be substituted and has a total C-number of 4 to 30, a linear or branched alkenyl group that may be substituted and has a total C-number of 4 to 30, or cycloalkyl group that may be substituted and has a total C-number of 4 to 30.

5. The method for forming a color image as claimed in claim 1, wherein $R^3$ in formula (I) represents a substituted or unsubstituted aryl group having a total C-number of 6 to 36.

6. The method for forming a color image as claimed in claim 1, wherein $R^1$ in formula (I) represents a linear or branched alkyl group that may be substituted and has a total C-number of 4 to 30.

7. The method for forming a color image as claimed in claim 1, wherein $R^2$ in formula (I) represents a linear of branched alkyl group that may be substituted and has a total C-number of 4 to 30.

8. The method for forming a color image as claimed in claim 1, wherein $R^3$ in formula (I) represents a phenyl group having at least one substituent selected from a halogen atom, a cyano group, a sulfonamido group, an alkylsulfonyl group, an arylsulfonyl group, and a trifluoromethyl group.

9. The method for forming a color image as claimed in claim 1, wherein Z in formula (I) represents a hydrogen atom, a halogen atom, an alkoxy group, an aryloxy group, or alkylthio group.

10. The method for forming a color image as claimed in claim 1, wherein Z in formula (I) represents a hydrogen atom, a chlorine atom or a group represented by the following formula (II) or (III):

Formula (II)

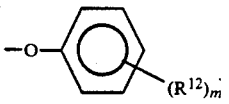

wherein $R^{12}$ represents a halogen atom, a cyano group, a nitro group, an alkyl group, an alkoxy group, an alkylthio group, an alkylsulfonyl group, an arylsulfonyl group, a carbonamido group, a sulfonamido group, an alkoxycarbonyl group, a carbamoyl group, a sulfamoyl group, or a carboxyl group, m is an integer of 0 to 5, if m is an integer of 2 to 5, groups $R^{12}$ may be the same or different.

Formula (III)

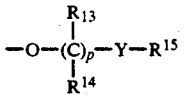

wherein $R^{13}$ and $R^{14}$ each represent a hydrogen atom or a monovalent group, Y represents -CO-, -SO-, $SO_2$-, -(O)P($R^{16}$)-, $R^{15}$ and $R^{16}$ each represent a hydroxyl group, an alkyl group, an aryl group, an alkoxy group, an alkenyloxy group, an aryloxy group, or a substituted or unsubstituted amino group, p is an integer of 1 to 6, if p is an integer of 2 to 6, groups -C($R^{13}$)($R^{14}$)- may be the same or different.

11. The method for forming a color image as claimed in claim 1, wherein Z in formula (I) represents a group capable of being released upon a coupling reaction not containing a photographically useful group.

12. The method for forming a color image as claimed in claim 1, wherein the layer containing the cyan coupler represented by formula (I) of the silver halide color photographic material is a hydrophilic colloid layer on a base.

13. The method for forming a color image as claimed in claim 1, wherein the layer containing the cyan coupler represented by formula (I) of the silver halide color photographic material is a photosensitive layer.

14. The method for forming a color image as claimed in claim 1, wherein the cyan coupler represented by formula (I) is added in an amount of 0.002 to 5 mmol per square meter of the silver halide color photographic material.

15. The method for forming a color image as claimed in claim 1, wherein the cyan coupler represented by formula (I) is used as a mixture with other cyan couplers and the cyan coupler represented by formula (I) is 50 mol % or more in all cyan couplers.

16. The method for forming a color image as claimed in claim 1, wherein $R^4$ in formula (D) is a methyl group.

17. The method for forming a color image as claimed in claim 1, wherein $R^5$ in formula (D) is an ethyl group and $R^6$ in formula (D) is a methyl group.

18. The method for forming a color image as claimed in claim 1, wherein the color-developing agent is a compound having the following structure:

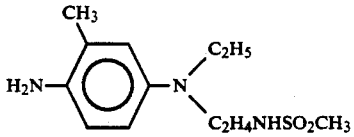

19. The method for forming a color image as claimed in claim 1, wherein the color-developing agent represented by formula (D) is contained in the amount of about 0.1 to about 2.0 g in a color developer.

20. The method for forming a color image as claimed in claim 1, wherein the color developer comprising the color-developing agent represented by formula (D) is substantially free from benzyl alcohol.

21. The method for forming a color image as claimed in claim 1, wherein the pH of color developer comprising the color-developing agent represented by formula (D) is 9 to 12.

* * * * *

UNITED STATES PATENT AND TRADEMARK OFFICE

CERTIFICATE OF CORRECTION

PATENT NO. : 5,183,729

DATED : February 2, 1993

INVENTOR(S) : Hideki Naito, et. al.

It is certified that error appears in the above-indentified patent and that said Letters Patent is hereby corrected as shown below:

Title page, item [30], change "March 12, 1990 [JP] Japan .....2-153629" to --June 12, 1990 [JP] Japan..... 2-153629--

Column 76, line 10, after "represents" insert --an alkyl group,--.

Signed and Sealed this

Eleventh Day of January, 1994

Bruce Lehman

*Attest:*

BRUCE LEHMAN

*Attesting Officer*

*Commissioner of Patents and Trademarks*